US009672801B2

(12) United States Patent
Yasuraoka

(10) Patent No.: US 9,672,801 B2
(45) Date of Patent: Jun. 6, 2017

(54) ELECTRONIC MUSICAL INSTRUMENT, STORAGE MEDIUM AND NOTE SELECTING METHOD

(71) Applicant: Yamaha Corporation, Hamamatsu-Shi, Shizuoka-Ken (JP)

(72) Inventor: Naoki Yasuraoka, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 14/518,516

(22) Filed: Oct. 20, 2014

(65) Prior Publication Data

US 2015/0107443 A1 Apr. 23, 2015

(30) Foreign Application Priority Data

Oct. 21, 2013 (JP) ..... 2013-218058

(51) Int. Cl.

| | |
|---|---|
| ***G10H 1/00*** | (2006.01) |
| ***G10H 1/18*** | (2006.01) |
| ***G10H 1/22*** | (2006.01) |
| ***G10H 1/34*** | (2006.01) |

(52) U.S. Cl.

CPC ..... *G10H 1/18* (2013.01); *G10H 1/22* (2013.01); *G10H 1/34* (2013.01); *G10H 1/183* (2013.01); *G10H 2210/095* (2013.01); *G10H 2210/161* (2013.01)

(58) Field of Classification Search

CPC .. G10H 1/18; G10H 1/00; G10H 1/22; G10H 1/34; G10H 1/0025; G06F 9/44; G06F 9/444

USPC ..... 84/615

See application file for complete search history.

(56) References Cited

U.S. PATENT DOCUMENTS

| | | | | |
|---|---|---|---|---|
| 5,473,108 | A * | 12/1995 | Matsuda | G10H 1/12 84/622 |
| 5,523,521 | A | 6/1996 | Suzuki | |
| 5,610,353 | A | 3/1997 | Hagino | |
| 6,316,710 | B1 * | 11/2001 | Lindemann | G10H 7/02 84/601 |
| 6,376,759 | B1 | 4/2002 | Suzuki | |

(Continued)

FOREIGN PATENT DOCUMENTS

| | | |
|---|---|---|
| EP | 1 653 441 A1 | 5/2006 |
| JP | H5-143073 A | 6/1993 |

(Continued)

OTHER PUBLICATIONS

European Search Report mailed Mar. 17, 2015, for EP Application No. 14188765.3, ten pages.

(Continued)

*Primary Examiner* — Jianchun Qin

(74) *Attorney, Agent, or Firm* — Morrison & Foerster LLP

(57) ABSTRACT

One or more assigners selecting a note to be sounded according to operation state of plural controls corresponding respectively to notes are provided, it is decided for each of the assigners whether or not to select a note to be sounded in response to a key-off operation of any of the controls, and when a key-off operation of any of the controls is detected, the assigner which is decided to select a note to be sounded, is instructed to select a note to be sounded according to operation state of the controls after the detection of the key-off operation.

8 Claims, 15 Drawing Sheets

(56) References Cited

U.S. PATENT DOCUMENTS

| | | | | |
|---|---|---|---|---|
| 8,017,856 | B2 | 9/2011 | Tanaka | |
| 2008/0066609 | A1 | 3/2008 | Bourgeois | |
| 2010/0077908 | A1* | 4/2010 | Tanaka | G10H 7/008 84/605 |

FOREIGN PATENT DOCUMENTS

| | | | |
|---|---|---|---|
| JP | H-06-149261 | A | 5/1994 |
| JP | 2565069 | B2 | 12/1996 |
| JP | 2010-79179 | A | 4/2010 |

OTHER PUBLICATIONS

European Office Action mailed Jan. 14, 2016, for EP Application No. 14188765.3, six pages.
European Communication mailed Nov. 15, 2016, for EP Application No. 14188765.3, seven pages.
Notification of Reasons for Refusal dated Apr. 18, 2017, for JP Application No. 2013-218058, with English translation, five pages.

* cited by examiner

Fig. 3

ASSIGNMENT RULE SETTING TABLE

| | TARGET DEPRESSED KEY | PRIORITY METHOD | DESCRIPTION |
|---|---|---|---|
| FIRST ASSIGNER (FIRST PART, TIMBRE T1) | ALL DEPRESSED KEYS | HIGHER-PITCH-PRIOR-TO-LOWER-PITCH | ALWAYS SELECT NOTE OF HIGHEST PITCH |
| SECOND ASSIGNER (SECOND PART, TIMBRE T2) | UP TO THREE NOTES FROM LOWER PITCH SIDE | HIGHER-PITCH-PRIOR-TO-LOWER-PITCH | WHEN NUMBER OF DEPRESSED KEYS IS THREE OR LESS, SELECT NOTE OF HIGHEST PITCH, AND WHEN NUMBER OF DEPRESSED KEYS IS FOUR OR MORE, SELECT NOTE OF THIRD LOWEST PITCH |
| THIRD ASSIGNER (THIRD PART, TIMBRE T3) | UP TO TWO NOTES FROM LOWER PITCH SIDE | HIGHER-PITCH-PRIOR-TO-LOWER-PITCH | WHEN NUMBER OF DEPRESSED KEYS IS TWO OR LESS, SELECT NOTE OF HIGHEST PITCH, AND WHEN NUMBER OF DEPRESSED KEYS IS THREE OR MORE, SELECT NOTE OF SECOND LOWEST PITCH |
| FORTH ASSIGNER (FORTH PART, TIMBRE T4) | ALL DEPRESSED KEYS | LOWER-PITCH-PRIOR-TO-HIGHER-PITCH | ALWAYS SELECT NOTE OF LOWEST PITCH |

Fig. 4

KEY-OFF RETRIGGER SETTING TABLE

| | KEY-OFF RETRIGGER |
|---|---|
| FIRST ASSIGNER | ON |
| SECOND ASSIGNER | ON |
| THIRD ASSIGNER | OFF |
| FOURTH ASSIGNER | OFF |

OPERATION HISTORY TABLE

| TIME | KEY DEPRESSION STATE | DETECTED OPERATION |
|---|---|---|
| t(1) | n1, n2, n4 | n1 KEY-ON, n2 KEY-ON, n4 KEY-ON |
| t(2) | n1, n2, n3, n4 | n3 KEY-ON |
| t(3) | n1, n2, n3 | n4 KEY-OFF |
| t(4) | n3 | n1 KEY-OFF, n2 KEY-OFF |
| t(5) | null | n3 KEY-OFF |

Fig. 22

ASSIGNMENT RULE SETTING TABLE
(MODIFICATION EXAMPLE)

| | RULE |
|---|---|
| FIRST ASSIGNER (FIRST PART, TIMBRE T1) | HIGHER-PITCH-PRIOR-TO-LOWER-PITCH REGARDLESS OF NUMBER OF DEPRESSED KEYS |
| SECOND ASSIGNER (SECOND PART, TIMBRE T2) | WHEN NUMBER OF DEPRESSED KEYS IS ONE TO THREE, SELECT NOTE OF HIGHEST PITCH. AND WHEN NUMBER OF DEPRESSED KEYS IS FOUR, SELECT NOTE OF SECOND HIGHEST PITCH |
| THIRD ASSIGNER (THIRD PART, TIMBRE T3) | WHEN NUMBER OF DEPRESSED KEYS IS ONE TO TWO, SELECT NOTE OF HIGHEST PITCH. AND WHEN NUMBER OF DEPRESSED KEYS IS THREE TO FOUR, SELECT NOTE OF SECOND LOWEST PITCH |
| FORTH ASSIGNER (FORTH PART, TIMBRE T4) | A NOTE OF THE LOWEST PITCH AMONG ALL THE NOTES OF THE KEYS REGARDLESS OF THE NUMBER OF DEPRESSED KEYS. |

ELECTRONIC MUSICAL INSTRUMENT, STORAGE MEDIUM AND NOTE SELECTING METHOD

TECHNICAL FIELD

The invention relates to an electronic musical instrument for selecting a note to be sounded according to operation state of plural controls, a storage medium storing a program for causing a computer to realize such a note selecting function, and a note selecting method selecting a note to be sounded according to operation state of the plural controls.

BACKGROUND ART

It has been conventionally known to provide an electronic musical instrument with plural assigners selecting a note to be sounded according to a predetermined rule from among notes of depressed keys, and sound the note selected by each assigner in a timbre corresponding to the assigner.

By using the plural assigners, for example, when rules are defined to make one assigner select a note on a low note side and another assigner select a note on a high note side, it is possible to selectively play sounds of low note side and high note side (for example, an accompaniment and a melody) automatically in different timbres. Further, depending on setting of rules, it is also possible to make plural assigners select the same note and perform tone generations like a unison performance in plural parts, or make plural assigners select different notes from each other and perform tone generations like an ensemble performance in plural parts.

Such an electronic musical instrument is described in, for example, PTL1.

Further, PTL2 discloses an electronic musical instrument which assigns a predetermined number of parts to notes of depressed keys based on rules according to the number of depressed keys, and sounds each note in a timbre of the part assigned to the note. This electronic musical instrument enables to sound a predetermined number of parts constantly irrespective of the number of depressed keys.

Further, besides them, PTL3 discloses a technology related to what is called a mono assigner which generates only a sound corresponding to one key in an electronic musical instrument. In PTL3, as a method to easily regenerate a musical sound desired to be sounded even if a misplay occurs when a performance is given while function of the mono assigner is enabled, there is described to generate, when a key being sounded is released, a musical sound corresponding to the key closest to the released key among keys being depressed.

CITATION LIST

Patent Literature

{PTL1} JP 2565069 B2
{PTL2} JP 2010-79179 A
{PTL3} JP H5 (1993)-143073 A

SUMMARY OF INVENTION

Technical Problem

Incidentally, when the above-described plural assigners are used to select notes to be sounded respectively, it is not always possible to perform a desired tone generation by the method described in PTL1.

For example, in a case where a previous sound and a subsequent sound are played sequentially like a legato performance, there has been a disadvantage in tone generation when the key of the subsequent sound is depressed before the key of the previous sound is released.

An example of this is illustrated in FIG. 15. In FIG. 15, a vertical axis represents a time, a horizontal axis represents a note, and a strip of each note represents a period in which a key of the note is depressed. In the example of FIG. 15, a key of the note n4 is depressed, and before this key is released, a key of the note n3 is depressed. Then, the key of the note n4 is released immediately thereafter, and hence this can be assumed as a performance intended to generate sound of note n4 and sound of note n3 sequentially.

However, in the method described in PTL1, each assigner is made to select a note to be sounded according to a key depressing operation, and meanwhile, when a key releasing operation is performed, only a key-off signal is sent to a tone generation channel generating sound corresponding to the released key. That is, selection of a note by the each assigner is not performed at the time of key releasing operation.

Therefore, for example, at a timing KON1,2,4 when the key of the note n4 is firstly depressed (simultaneously with keys of n1 and n2), the respective assigners select a note to be sounded in a state that the three keys of the notes n1, n2 and n4 are depressed. However, at a timing KON3 when the key of the note n3 is depressed, the respective assigners select a note to be sounded in a state that the four keys of the notes n1 to n4 are depressed. Further, at a timing KOFF4 when the key of the note n4 is released immediately thereafter, sound generated for the note n4 is simply muted.

Accordingly, relation between note order of the keys being depressed and note being selected by each assigner may differ between in a period from KON1,2,4 to KON3 and in a period after KOFF4. Specifically, although an intention to sequentially generate sound of the note n4 and the sound of the note n3 can be assumed from the performance operation, sounds of these notes may be generated in different timbres, resulting in an unnatural tone generation.

PTL2 describes, although different from the method of using plural assigners, mis-legato processing for preventing an unnatural tone generation in case of such legato performance. This mis-legato processing is to, when there occurs a note-off during a mis-legato judgment time from a note-on of the latest note being sounded, redo part assignment to the notes and tone generation.

In this manner, when the performance operation as in FIG. 15 is performed, if the period from KON3 to KOFF4 is within the mis-legato judgment time, the assignment can be redone at the timing KOFF4, and after KOFF4 the tone generation corresponding to the three depressed keys of the notes n1 to n3 can be performed.

However, in the mis-legato processing of PTL2, there is a problem that setting of the mis-legato judgment time is difficult. Specifically, when a time in which a previous key and a subsequent key are depressed together exceeds the mis-legato judgment time, the reassignment will not be performed when the previous key is released. The shorter the mis-legato judgment time is, the more often the legato performance operation falls under this condition and the higher the risk of not being judged as legato is.

On the other hand, when the mis-legato judgment time is set to be too long, it is conceivable that even in a performance intended to partly overlap sounds instead of the legato performance, the reassignment is made when the previous key is released, resulting in a tone generation which is conversely different from the performer's intention.

Further, in the mis-legato processing of PTL2, the reassignment is performed for all the notes being depressed at the time of reassignment. Accordingly, there has been a problem that at the time of reassignment, assignments of parts may change unintentionally regarding sounds like the notes n1 and n2 in FIG. 15 which are irrelevant to the legato performance.

Note that the above legato performance is merely an example of the case where a desired performance cannot be performed, and besides this case, a similar problem may occur when there is a poor compatibility between a performance method or performance operation and rules for selecting a note in the assigners.

Further, also when the electronic musical instrument is not a keyboard instrument, such a problem may occur similarly when notes to be sounded are selected according to operation state of plural controls respectively corresponding to notes.

The invention has been made in view of such situations, and it is an object thereof to allow easily performing a tone generation which matches the intention of a performance operation by a performer when one or more selectors are made to select notes to be sounded according to operation state of controls.

Solution to Problem

To attain the above object, an electronic musical instrument of the invention including: one or more selectors respectively configured to select a note to be sounded according to operation state of plural controls corresponding respectively to notes; a decider configured to decide, for each of the selectors, whether or not to select a note to be sounded in response to a tone generation stopping operation of any of the controls; and a controller configured to instruct, when a tone generation stopping operation of any of the controls is detected, a selector which is decided to select a note to be sounded, to select a note to be sounded according to operation state of the plural controls after the detection of the tone generation stopping operation.

In such an electronic musical instrument, it is conceivable that the decider decides, for each of the selectors, whether or not to select a note to be sounded, based on a setting performed by a user for each selector regarding whether or not to select a note to be sounded in response to a tone generation stopping operation of any of the controls.

It is also conceivable that the decider decides, for each of the selectors, that, when the tone generation stopping operation of any of the controls is detected, if pitch difference is equal to or more than a predetermined value between a note selected by one selector at a timing of the detection and a note predicted to be selected by the one selector according to operation state of the plural controls after the detection of the tone generation stopping operation, the one selector does not select a note to be sounded in response to a tone generation stopping operation of any of the controls, and if the pitch difference is less than the predetermined value, the one selector selects a note to be sounded in response to a tone generation stopping operation of any of the controls.

It is also conceivable that when the tone generation stopping operation of any of the controls is detected, the decider presumes a performance method used in the detected tone generation stopping operation, and makes the decision related to a target selector which is selecting a note for which the tone generation stopping operation is performed based on the presumed performance method.

Further, it is also conceivable that when the presumed performance method is legato performance, the decider decides that the target selector selects a note to be sounded in response to a tone generation stopping operation of any of the controls.

Furthermore, it is also conceivable that wherein assuming the note for which the tone generation stopping operation is performed as note N, the decider presumes that the detected tone generation stopping operation is an operation for legato performance if there is a note M different from the note N satisfying conditions that: operations are performed in an order of a tone generation starting operation for the note N, a tone generation starting operation for the note M, and the tone generation stopping operation for the note N; and at a time of the tone generation starting operation for the note M, none of the controls corresponding to a note between the note M and the note N is being operated.

Alternatively, it is also conceivable that when the presumed performance method is staccato performance, the decider decides that the target selector does not select a note to be sounded in response to a tone generation stopping operation of any of the controls.

In the above electronic musical instruments it is also conceivable that while a certain control is operated, the decider forcibly decides for a predetermined selector among the selectors either one of to select or not to select a note to be sounded in response to a tone generation stopping operation of any of the controls.

It is also conceivable that, for each of the selector, a rule related to a note to be selected by the selector and a timbre to be applied to a sound of a note selected by the selector are set in advance.

The invention can be realized or embodied also as method, system, machine readable storage medium, computer program, or other arbitrary manner other than the above described devices.

Advantageous Effects of Invention

With a configuration of the invention as above, it is possible to easily perform a tone generation which matches intention of a performance operation by a performer when one or more selectors are made to select notes to be sounded according to operation state of controls.

BRIEF DESCRIPTION OF DRAWINGS

FIG. 3 is a diagram illustrating an example of sounding note selecting rules set in the assigners.

FIG. 4 is a diagram illustrating an example of presence of key-off retrigger set in the assigners.

FIG. 22 is a diagram illustrating an example different from FIG. 3 of sounding note selecting rules set in assigners.

DESCRIPTION OF EMBODIMENTS

Hereinafter, modes for carrying out the invention will be described specifically based on the drawings.

[First Embodiment: FIG. 1 to FIG. 11]

Figure 1:
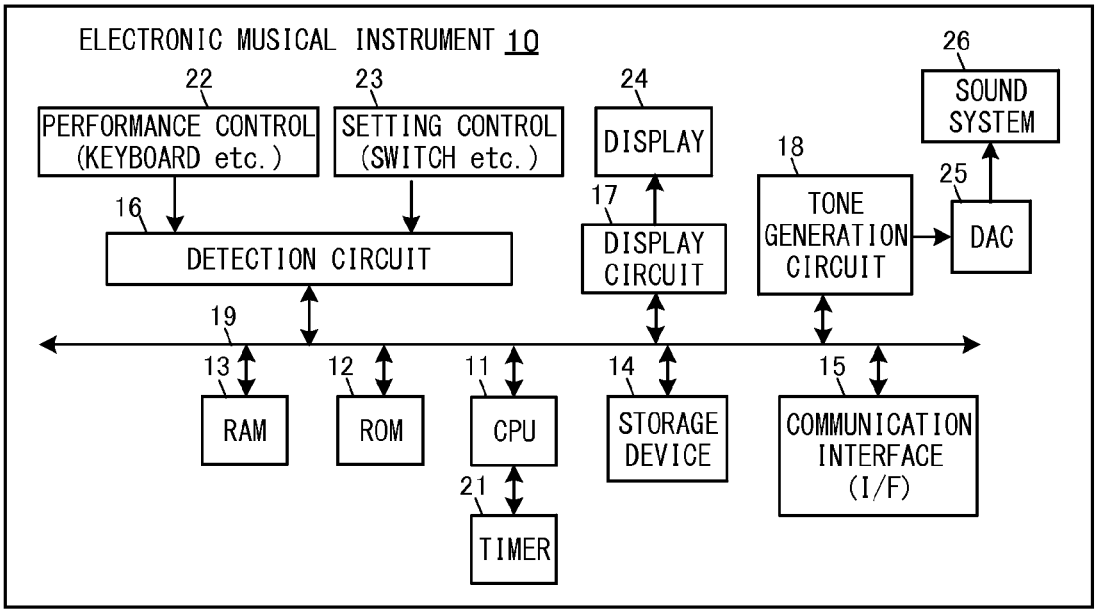
FIG. 1 is a block diagram illustrating a hardware structure of an electronic musical instrument which is a first embodiment of the invention.

FIG. 1 is a block diagram illustrating a hardware structure of an electronic musical instrument which is a first embodiment of the invention.

As illustrated in FIG. 1, an electronic musical instrument 10 has a CPU 11, a ROM 12, a RAM 13, a storage device 14, a communication interface (I/F) 15, a detection circuit 16, a display circuit 17, and a tone generation circuit 18, which are connected via a system bus 19. Further, the electronic musical instrument 10 also has a timer 21 connected to the CPU 11, a performance control 22 and a setting control 23 connected to the detection circuit 16, a display 24 connected to the display circuit 17, a DAC (digital analog converter) 25 connected to the tone generation circuit 18 and a sound system 26.

Then, the CPU 11 executes a required program stored in the ROM 12 or the storage device 14 using the RAM 13 as a work area to control the entire electronic musical instrument 10, realizing various functions such as detection of performance operation, selection of sounding note corresponding to operation state of performance controls, control of tone generation according to the selection, and so on. The timer 21 connected to the CPU 11 supplies a basic clock signal, an interrupt processing timing, and the like to the CPU 11.

Note that the ROM 12 stores, besides the above program, various data files of waveform data corresponding to timbres and the like, various parameters and various tables, and the like.

The RAM 13 is used as a buffer area of a reproduction buffer or the like, besides the work area of the CPU 11.

The storage device 14 is constituted of at least one combination of a storage medium such as a hard disk, a semiconductor memory, or the like and a drive device thereof.

The communication I/F 15 is an interface for communicating with external apparatuses such as a server, an audio apparatus, an external controller, or the like, and can be constituted of a communication device of any standard irrespective of wireless or wired. For example, it is conceivable to use a USB (Universal Serial Bus), or a MIDI (Musical Instrument Digital Interface) I/F.

The detection circuit 16 is an interface for connecting the performance control 22 and the setting control 23 to the system bus 19.

The performance control 22 are connected to the detection circuit 16, and supplies performance information (performance data) according to a performance operation of the user. The performance control 22 has plural controls corresponding respectively to notes, for accepting a performance operation of a user. Each of the controls supplies an operation start timing and an operation end timing with respect to the control by the user as key-on data and key-off data including information of the pitch corresponding to the control operated by the user to the CPU 11 via the detection circuit 16. Further, the performance control 22 can also supply various parameters such as a velocity value corresponding to the performance operation of the user. Note that in this example, a performance control 22 is assumed to be of keyboard type and the above respective controls are assumed to be keys, but they are not restrictive.

Further, the performance control 22 includes a retrigger release control, which is a specific control for instructing to temporarily disable a key-off retrigger, which will be described later. This retrigger release control is desirably one which can be operated without using hands, such as a pedal, so that they can be operated while the keyboard is played, and here it is assumed to be a pedal.

Further, the setting control 23 may be any one as long as it is able to output a signal corresponding to the user's input, such as a button, a slider, a rotary encoder, a text inputting keyboard, a mouse, or the like for example. Further, the setting control 23 may be a pointing device for performing an operation on a GUI (Graphical User Interface) displayed on the display 24, or a touch panel laminated on the display 24.

In any case, the user can perform various inputs and settings, selections by using the setting control 23.

The display circuit 17 is an interface for connecting the display 24 to the system bus 19.

The display 24 is a display device for displaying various information for setting of the electronic musical instrument 10, an operation state of the electronic musical instrument 10, and the like, and can be constituted of, for example, a liquid crystal display device, light emitting diodes (LED), and the like.

The tone generation circuit 18 has a function to generate an audio signal (digital waveform data) by plural tone generation channels according to a tone generation instruction from the CPU 11. The tone generation instruction from the CPU 11 includes a specification of a timbre, a note, a sound volume, and the like. When a performance operation to the performance control 22 is detected, the CPU 11 selects a note to be sounded corresponding to each assigner from among notes of keys being depressed by function of the assigners, and instructs tone generation according to the selection to the tone generation circuit 18. Details thereof will be described later.

The tone generation circuit 18 outputs a generated audio signal to the DAC 25. The DAC 25 converts the audio signal into an analog audio signal, and supplies it to the sound system 26 connected to the DAC 25. The sound system 26 is a sound generator including an amplifier and a speaker, and performs a sound generating output of the analog audio signal supplied from the DAC 25. The DAC 25 and the sound system 26 may be located outside the electronic musical instrument 10.

A characteristic point in the electronic musical instrument 10 above is a point related to operation of the assigner. Accordingly, the operation of the assigner will be described more specifically next.

Figure 2:
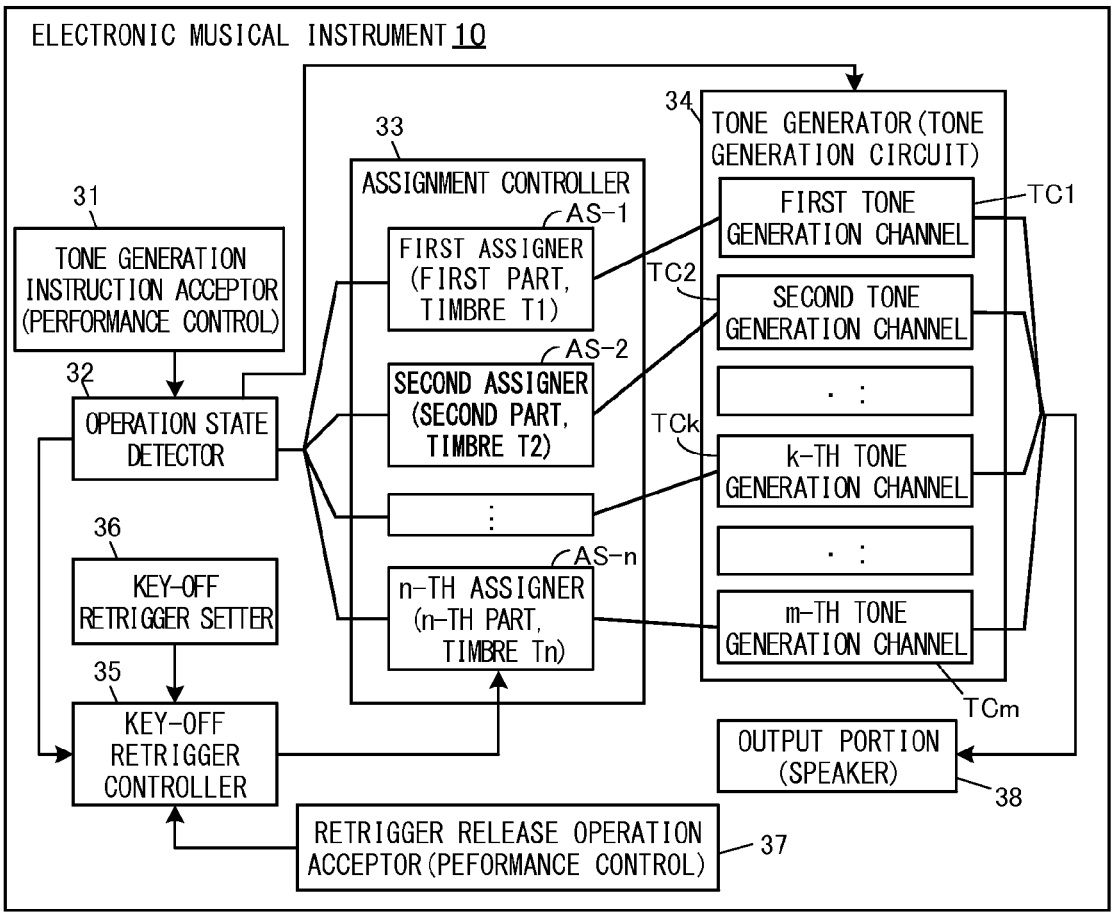
FIG. 2 is a functional block diagram of functions related to tone generation control using assigners in the electronic musical instrument illustrated in FIG. 1.

FIG. 2 illustrates a functional block diagram of functions related to tone generation control using the assigner in the electronic musical instrument 10.

As illustrated in FIG. 2, the electronic musical instrument 10 has a tone generation instruction acceptor 31 (tone generation instruction receiving portion), an operation state detector 32, an assignment controller 33, a tone generator 34, a key-off retrigger controller 35, a key-off retrigger setter 36, a retrigger release operation acceptor 37 (retrigger release operation receiving portion), and an output portion 38. Among them, functions of the tone generation instruction acceptor 31 and the retrigger release operation acceptor 37 are realized by the performance control 22 and the detection circuit 16, functions of the tone generator 34 are realized by the tone generation circuit 18, and functions of the output portion 38 are realized by the sound system 26. Functions of other respective portions are realized by the CPU 11.

The tone generation instruction acceptor 31 has a function to accept (receive) a tone generation instructing operation by the user. For example, when the keyboard as the performance control 22 accepts a key depressing operation (tone generation starting operation) of any key, the tone generation instruction acceptor 31 detects the operation, and transmits to the operation state detector 32 key-on data as an operation signal indicating the occurrence of the key depressing operation and a note number which indicates a pitch of the depressed key. When a key releasing operation (tone generation stopping operation) is accepted, the tone generation instruction acceptor 31 transmits to the operation state detector 32 key-off data indicating the occurrence of the key releasing operation and note number of the released key similarly.

Note that in the following description, an operation to instruct start of tone generation, such as a key depression, will be referred to as a "key-on operation", and an operation to instruct stop of tone generation, such as a key release, will be referred to as a "key-off operation". Further, a state from the key-on operation to the key-off operation will be referred to as "being operated". In the case of a key of a keyboard, "being depressed" corresponds to the "being operated". However, when there is an instruction of start of tone generation, the tone generation is not always started actually. This is because there may be cases where a setting not to perform tone generation for a certain note (pitch) is allowed, or a limit is provided to the number of simultaneous tone generations.

The operation state detector 32 detects current operation state (here a key depression state because it is a keyboard) of the performance control 22 based on the operation signal transmitted from the tone generation instruction acceptor 31. More specifically, the note (of the key) being operated is obtained. This key depression state can be obtained by, for example, adding a note number included in key-on data to a list of notes being operated, and deleting a note number included in key-off data from the list of notes being operated.

Upon detecting the key-on data, the operation state detector 32 supplies information of the detected operation state to the assignment controller 33 and makes the assignment controller 33 select a note to be sounded. A specific supply destination is an assigner whose function is enabled out of n assigners from a first assigner AS-1 to an n-th assigner AS-n provided in the assignment controller 33.

Note that when a person gives a performance, even when he or she had intended to perform operations of plural keys simultaneously, it is difficult to perform the operations at exactly the same timing. Thus, as long as a timing difference of plural operations is within a predetermined threshold (for example, about 15 to 30 milliseconds) of the degree that they can be assumed as simultaneous operations, it is desired to handle these operations as performed simultaneously. The description here will be given assuming that this handling is employed. It is also possible that key-on operation of a certain key and key-off operation of another key are performed simultaneously.

Moreover, the operation state detector 32 has a function to stop tone generation of a note for which key-off operation is performed in the tone generator 34 when the key-off data is received.

Moreover, upon receiving the key-off data, the operation state detector 32 notifies the reception and the note thereof to the key-off retrigger controller 35, and makes the key-off retrigger controller 35 judge whether or not it is necessary for the assigner AS to select a note to be sounded according to the key-off operation. This point will be described later.

Next, the assignment controller 33 has one or more (here, n) assigners AS-1 to AS-n (when it is not necessary to specify an individual assigner, a symbol "AS" is used). Each assigner AS is a selector selecting a note to be sounded by the tone generator 34 from among notes being operated (being depressed) according to information of operation state of the performance control 22 supplied in response to the key-on operation from the operation state detector 32. This selection is performed according to rules set in every assigner.

FIG. 3 illustrates an example of rules set in the assigners.

FIG. 3 illustrates an example of using four assigners, and the rule set to each assigner is constituted of items "target depressed key" and "priority method". The item "description" is a description for helping understanding of the rules determined by information of the other items, and is not used for selection processing.

The item of "target depressed key" is for determining what range of notes being depressed should be considered as a target of the selection. "All depressed keys" indicates that all the notes being depressed are considered. "UP to X notes from lower pitch side" indicates that only up to X notes from a lower pitch side are considered among the notes being depressed, and if the number of notes being depressed is less than X, all the notes being depressed are considered. Further, although not illustrated in FIG. 3, setting of "up to X notes from higher pitch side" is likewise possible.

The item of "priority method" is for determining how a note to be sounded is selected from among the notes considered as a target of the selection. "Higher-pitch-prior-to-lower-pitch" indicates that a note of the highest pitch among the notes considered is selected. "Lower-pitch-prior-to-higher-pitch" indicates that a note of the lowest pitch among the notes considered is selected.

From the above, regarding the first assigner, it can be seen that a rule to select a note of the highest pitch from among all the notes of the keys being depressed is set.

Regarding the second assigner, when the number of depressed keys is three or less, a note of the highest pitch is selected from the notes of the keys being depressed. When the number of depressed keys is four or more, a note of the highest pitch among the three notes from lower pitch side, namely, a note of the third lowest pitch is selected.

Regarding the third assigner, similarly, when the number of depressed keys is two or less, a note of the highest pitch is selected from the notes of the keys being depressed, or when the number of depressed keys is three or more, a note of the second lowest pitch is selected.

Regarding the fourth assigner, it can be seen that a rule to select a note of the lowest pitch from among all the notes of the keys being depressed is set.

Any assigner not presented in the table may be considered such that its function is disabled.

When selecting a note to be sounded according to the above rules, each assigner AS instructs the tone generator 34 to start tone generation of the selected note (send a tone generation starting instruction). Further, a correspondence with one of timbres T1 to Tn is set to each assigner AS, and the assigner AS instructs the tone generator 34 to generate a tone (sound) in the corresponding timbre (applying the corresponding timbre to the sound to be generated). Note that it is also possible to set a corresponding part to the assigner AS, and set a timbre corresponding to the part. In this case, the assigner AS and the timbre are corresponded with each other via the part, and the part corresponded with the assigner AS-n is expressed as n-th part.

Note that each assigner AS retains information regarding what note the assigner AS itself selected last time until the assignor AS selects a note next time. Then, even when the assignor AS selects a note, if the selected note is the same as that in the previous selection and the selected note is not a note for which the key-on operation is presently performed (being operated from before), the assignor AS preferably does not instruct the tone generator 34 to generate sound. This is because, in this case, it is conceivable that the note presently selected by the relevant assigner AS is not related to the presently detected key-on operation, and it will be desired to continue the tone generation started in response to a key-on operation before.

Further, in this example, to simplify the description, the description will be given such that each assigner selects one note, but it is also possible to set a rule allowing a selection of plural notes. One example is to select up to two notes by the higher-pitch-prior-to-lower-pitch.

Further, it would not be a problem if plural assigners select the same note. In this case, the selected note will be sounded in plural timbres, respectively.

The tone generator 34 has m tone generation channels TC1 to TCm (when it is not necessary to identify an individual tone generation channel, a symbol "TC" is used). When receiving a tone generation starting instruction from the assigner AS, the tone generator 34 searches for a tone generation channel not being generating sound, and make the found tone generation channel TC produce an audio signal (perform tone generation) of musical sound of the pitch and the timbre specified by the tone generation starting instruction. Note that in FIG. 2, the assigner AS and the tone generation channel TC are coupled with lines, but this does not mean that there is a fixed correlation between them.

Further, the tone generator 34 has a function to, upon instructed to stop a tone generation of a certain note by the operation state detector 32, a search for a tone generation channel TC which is performing tone generation of the certain note from among the tone generation channels TC, and make the found tone generation channel stop the tone generation. This stop includes shift to a release state.

Further, the tone generator 34 mixes audio signals generated by the respective tone generation channels TC and supplies the resultant signal to the output portion 38, making the output portion 38 output a sound according to the signal.

Next, the key-off retrigger controller 35 has a function of a decider deciding, upon notified that there is a key-off operation from the operation state detector 32, whether or not it is necessary to make the assigner AS select a note to be sounded in response to the key-off operation for each assigner AS of the assignment controller 33. Then, when deciding that it is necessary, the key-off retrigger controller 35 instructs the relevant assigner AS to select a note to be sounded.

Making the assigner select a note to be sounded in response to key-off operation in this manner will be referred to as "key-off retrigger". Further, the assigner AS which receives an instruction for the key-off retrigger performs processing of selecting a note to be sounded and instructing the tone generator 34 to start tone generation similarly to the case of selection in response to an instruction from the operation state detector 32. The instruction itself need not be distinguished in particular between the case of the selection in response to a key-on and the case of the key-off retrigger.

The key-off retrigger setter 36 has a function to set whether or not to perform the key-off retrigger for every assigner AS. This setting is made according to an operation of the setting control 23 by the user, and data of the setting is stored in a key-off retrigger setting table illustrated in FIG. 4 for example.

The retrigger release operation acceptor 37 has a function to accept (receive) an operation of the pedal which is a retrigger release control by the user. When the pedal in the performance control 22 is depressed down or released from the depression, the retrigger release operation acceptor 37 detects the operation, and supplies the key-off retrigger controller 35 with information of the operation state (whether it is depressed down or not) of the pedal at an appropriate time.

The key-off retrigger controller 35 decides whether or not to perform the key-off retrigger for every assigner AS based on the setting made by the key-off retrigger setter 36 and the information of the operation state of the retrigger release control supplied from the retrigger release operation acceptor 37. Details of this decision will be described later.

Next, processing which is executed by the CPU 11 for realizing functions which the CPU 11 are responsible for among the functions illustrated in FIG. 2 will be described.

Figure 5:
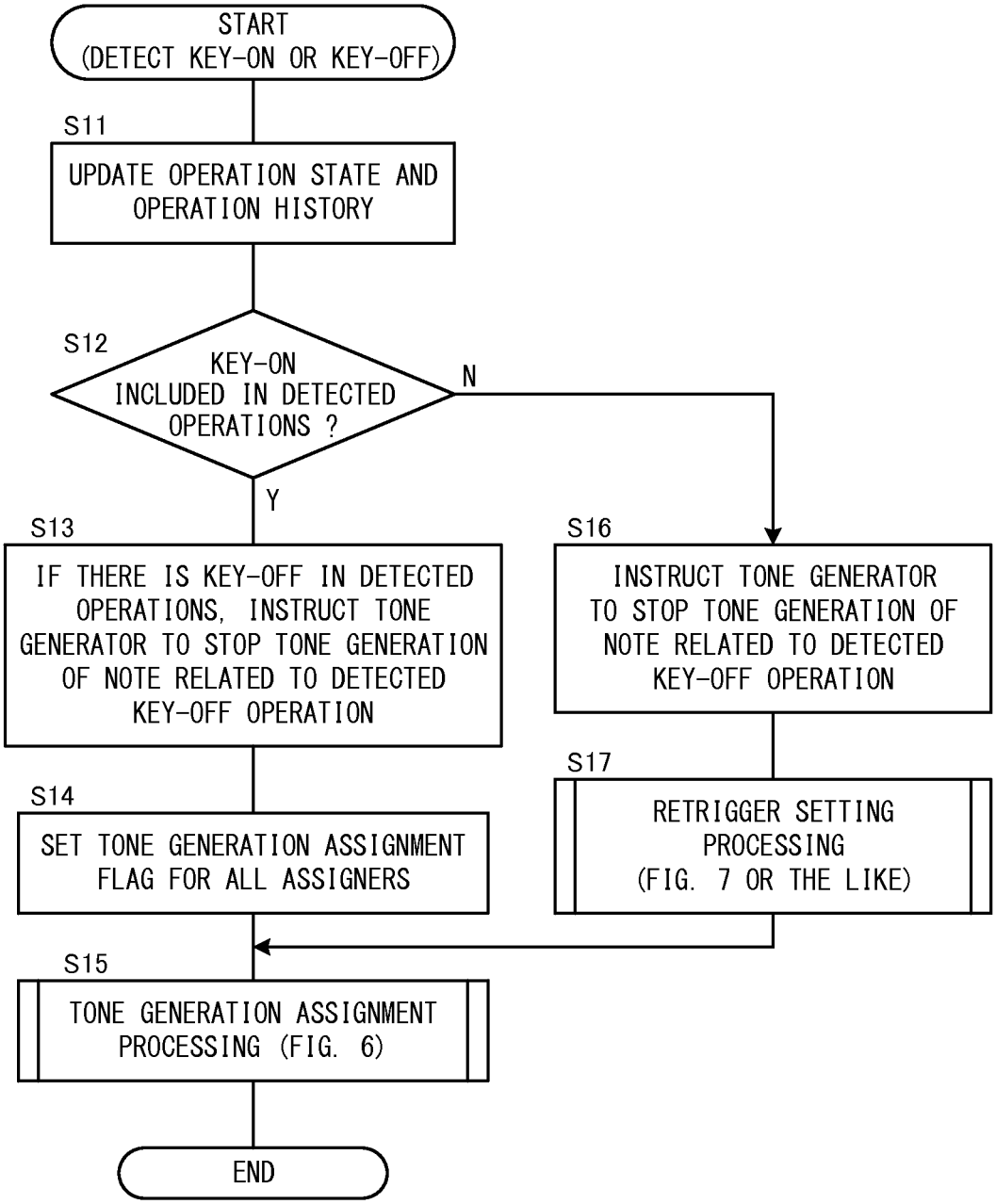
FIG. 5 is a flowchart illustrating processing executed by a CPU in the electronic musical instrument illustrated in FIG. 1.
Figure 6:
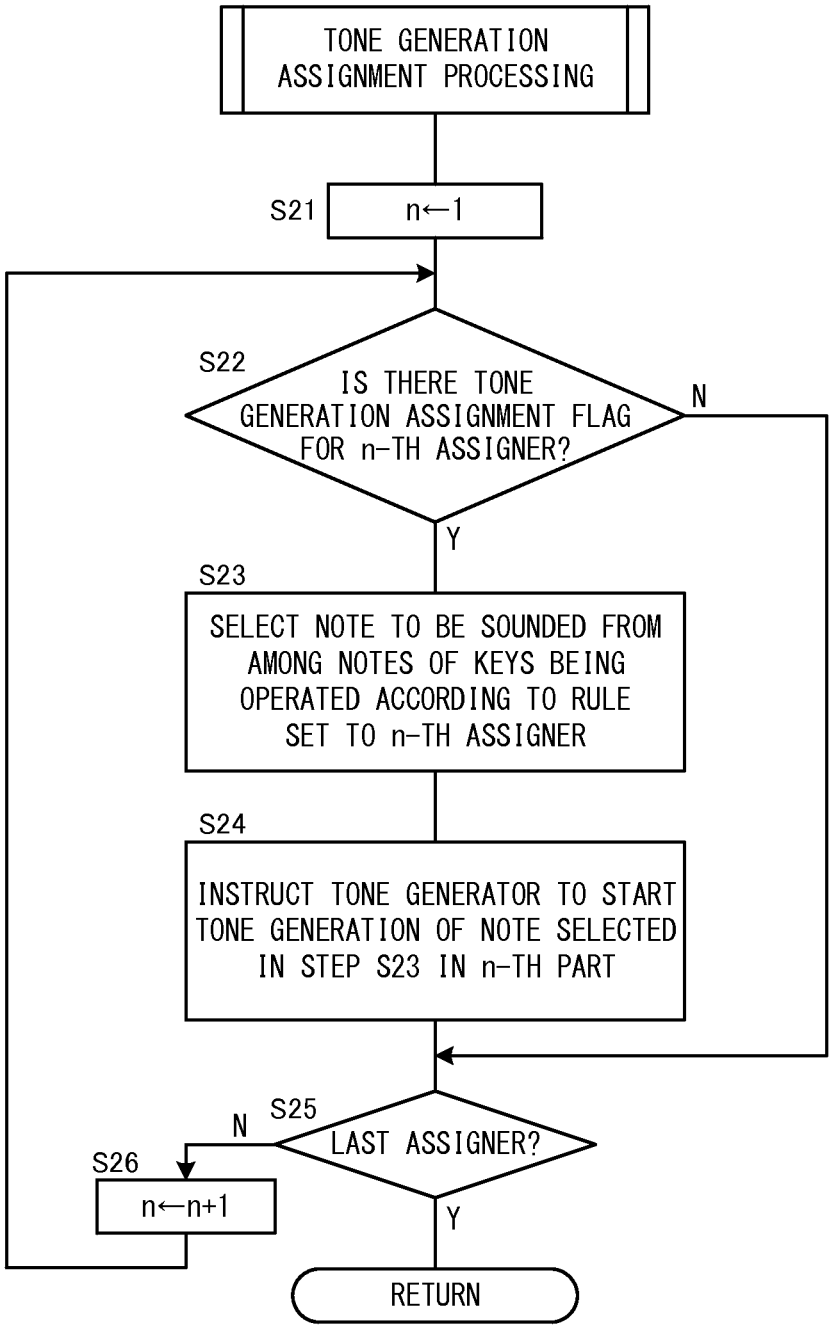
FIG. 6 is a flowchart of tone generation assignment processing illustrated in FIG. 5.
Figure 7:
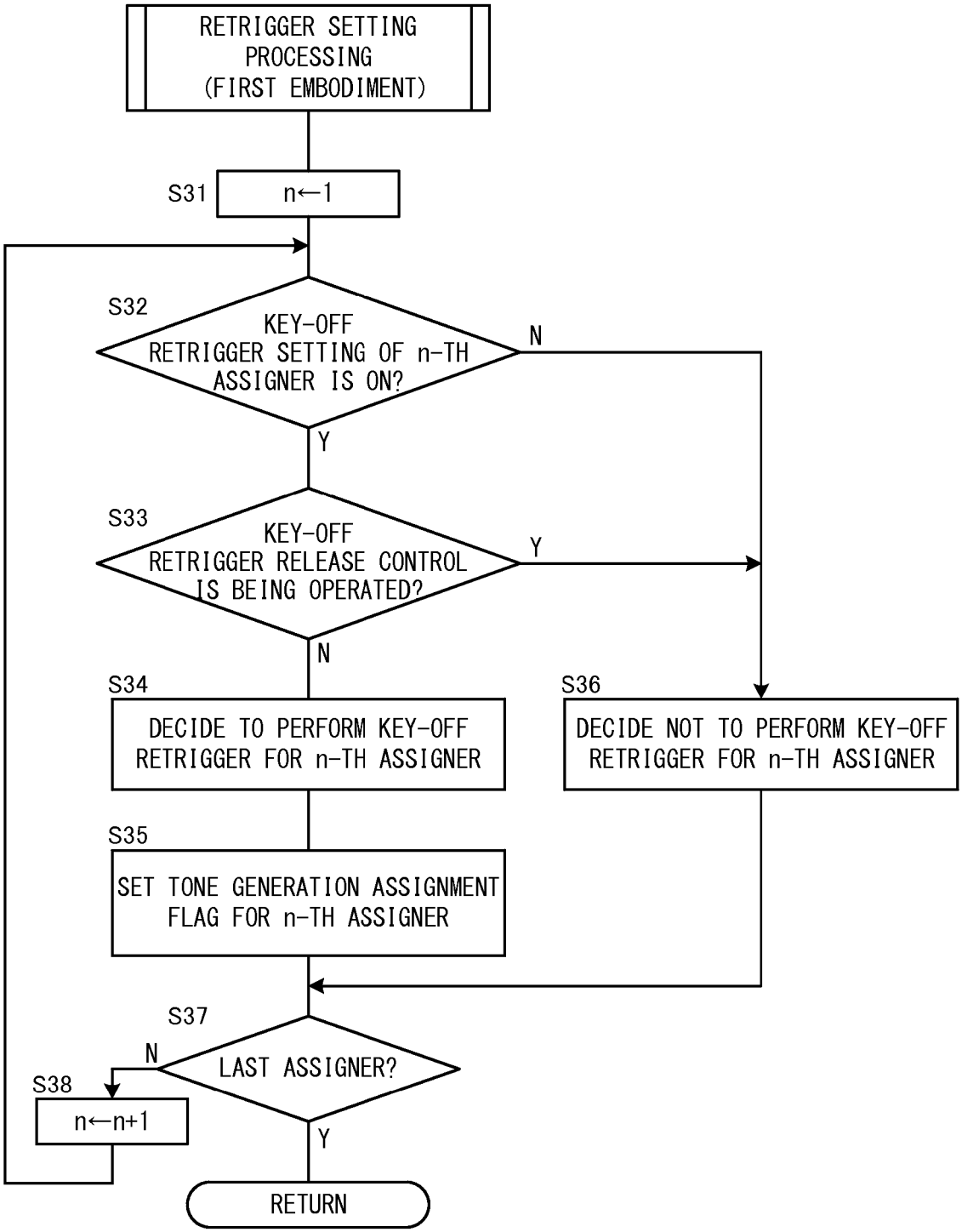
FIG. 7 is a flowchart of retrigger setting processing illustrated in FIG. 5.

FIG. 5 to FIG. 7 are flowcharts of this processing.

Upon receiving the key-on data and/or key-off data from the detection circuit 16, the CPU 11 starts processing illustrated in the flowchart of FIG. 5 by executing a required program. Note that operations performed with a timing difference within the predetermined threshold will be assumed as simultaneous operations as described above.

In the processing of FIG. 5, the CPU 11 first updates information of key depression states of respective keys based on the operation of the performance control 22 indicated by the received key-on data and/or key-off data (S11).

Next, the CPU 11 judges whether a key-on operation is included in the detected operation or not (S12). When plural operations are detected simultaneously, it is Yes if there is at least one key-on operation therein.

Then, when it is Yes, if there is a key-off operation in the detected operation, the CPU 11 instructs the tone generator 34 to stop tone generation of the note related to the detected key-off operation (S13). Thereafter, the CPU 11 sets a tone generation assignment flag for all the assigners AS (S14) in order to select a note to be sounded in response to the detected key-on operation by the assigners AS, and then the process proceeds to tone generation assignment processing described in FIG. 6 (S15).

In the processing of FIG. 6, the CPU 11 first substitutes 1 for a variable n (S21). Then, the CPU 11 judges whether or not the tone generation assignment flag is set for the n-th assigner AS-n (S22).

When the flag is set here, the CPU 11 selects a note to be sounded from among notes of keys being operated (S23) according to the rule set to the n-th assigner AS-n. Then, the CPU 11 instructs the tone generator 34 to start tone generation of the note selected in step S23 in the n-th part corresponding to the n-th assigner AS-n (S24). In this case, a timbre used for the tone generation is the timber set with respect to the n-th part.

Steps S23 and S24 above are processing corresponding to one assigner AS. Thereafter, the CPU 11 judges whether the currently processed assigner is the last assigner or not (S25), and if it is not, adds 1 to n (S26), and the process returns to step S22 to repeat the processing.

When it is No in step S22, the selection of note is not performed regarding the n-th assigner, and thus the process proceeds to step S25 while skipping the intervening steps.

When it is No in step S25, it can be seen that the processing regarding all the assigners AS has finished, and thus the processing of FIG. 6 is finished and the CPU 11 returns to the original processing. Here, it returns to step S15 of FIG. 5, and thus the CPU 11 merely finishes the processing. Note that when the process proceeds from step S14 to step S15, the note selection and the tone generation instruction regarding all the assigners are performed in the tone generation assignment processing.

Note that before starting the processing of FIG. 6, the tone generation assignment flag for all the assigners may be confirmed first, and then steps S23 and S24 may be executed only for an assigner with the flag. In this case, if there is no assigner having the flag, the tone generation assignment processing itself can be skipped.

On the other hand, when it is No in step S12 of FIG. 5, that is, when the detected operation is only the key-off operation, the CPU 11 instructs the tone generator 34 to stop tone generation of the note related to the detected key-off operation (S16). Thereafter, the process proceeds to retrigger setting processing illustrated in FIG. 7 (S17). Note that when plural key-off operations are detected, the CPU 11 instructs to stop tone generation for each of the detected key-off operations.

In the processing of FIG. 7, the CPU 11 first substitutes 1 for the variable n (S31). Then, for the n-th assigner AS-n, the CPU 11 judges whether the setting of key-off retrigger illustrated in FIG. 4 is ON or not (S32). When it is Yes (ON), the CPU 11 further judges whether the retrigger release control is being operated or not (S33). When it is not operated, the CPU 11 decides to perform the key-off retrigger for the n-th assigner (S34), and sets the tone generation assignment flag for the n-th assigner (S35).

On the other hand, when it is No in step S32, that is, when the setting of key-off retrigger is OFF, the CPU 11 decides not to perform the key-off retrigger for the n-th assigner (S36). In this case, the tone generation assignment flag is not set for the n-th assigner. The same applies when the retrigger release control is being operated in step S33.

In either case, thereafter, the CPU 11 judges whether the currently processed assigner is the last assigner or not (S37), and when it is not the last, adds 1 to n (S38), and the process returns to step S32 to repeat the processing.

When it is Yes in step S37, it can be seen that the processing regarding all the assigners is finished, and thus the CPU 11 ends the processing of FIG. 7 and returns to the original processing. At this time, since the CPU 11 returns to step S17 of FIG. 5, in the processing of FIG. 5 the CPU 11 then proceeds to the tone generation assignment processing of FIG. 6 (S15). In this tone generation assignment processing, the judgment of step S22 is Yes only for the assigner AS for which the tone generation assignment flag is set in step S35, and selection of a note to be sounded and tone generation starting instruction are performed.

The processing of FIG. 5 to FIG. 7 above is processing related to a first embodiment of note selecting method of the invention. Further, the tone generation assignment processing of FIG. 6 corresponds to a selecting step, from step S12 and subsequent steps of FIG. 5 correspond to a control step, and the retrigger setting processing of FIG. 7 corresponds to a deciding step. Further, in the processing from step S12 and subsequent steps of FIG. 5, the CPU 11 functions as a controller. In the retrigger setting processing of FIG. 7, the CPU 11 functions as a decider.

By executing the above processing, the CPU 11 can appropriately discriminate, according to the setting by the user, the case where the assigner AS should perform the selection of the note to be sounded and the tone generation starting instruction in response to key-off operation, and have it performed. Moreover, when the retrigger release control is being operated, temporarily and forcibly the key-off retrigger can be set to OFF irrespective of the setting for every assigner AS. This enables to perform tone generation which matches the intention of the user's performance operation. Further, it is not necessary to do the setting of parameter values by trial and error, such as the mis-legato judgment time described in PTL2, in order to perform the above tone generation.

Note that when it is Yes in step S12 of FIG. 5, it is not necessary to consider the key-off retrigger because the selection of note to be sounded is always performed regarding all the assigners in response to the key-on operation. The retrigger judgment processing may be performed, but there is no difference in performing the selection of note to be sounded regarding all the assigners irrespective of the result.

Next, effects of the retrigger setting processing will be described using FIG. 8 to FIG. 11.

Figure 8:
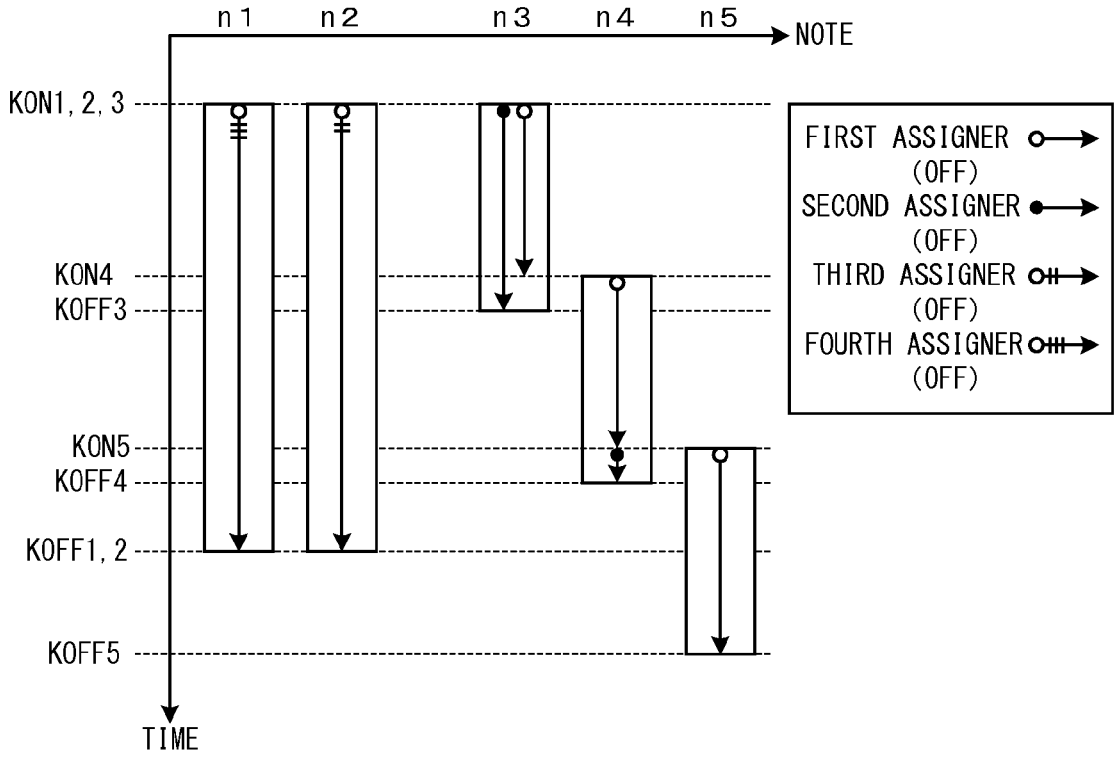
FIG. 8 is an explanatory diagram for describing an effect of the retrigger setting processing of the first embodiment.
Figure 9:
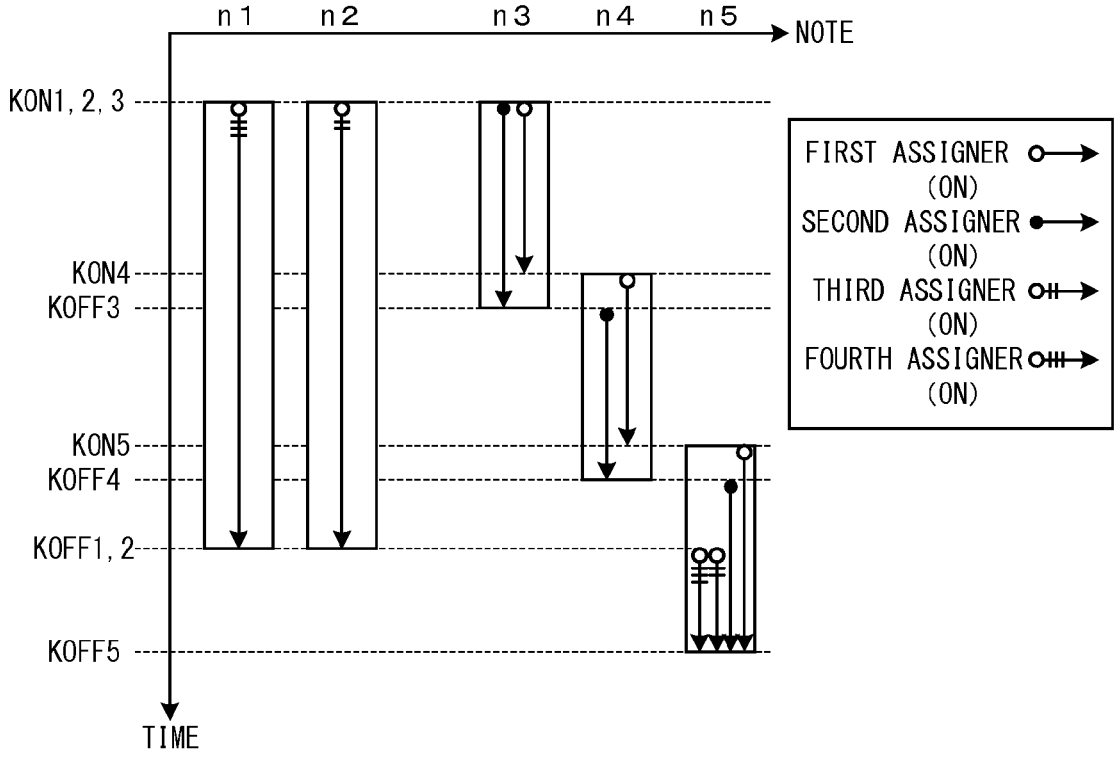
FIG. 9 is another explanatory diagram thereof.
Figure 10:
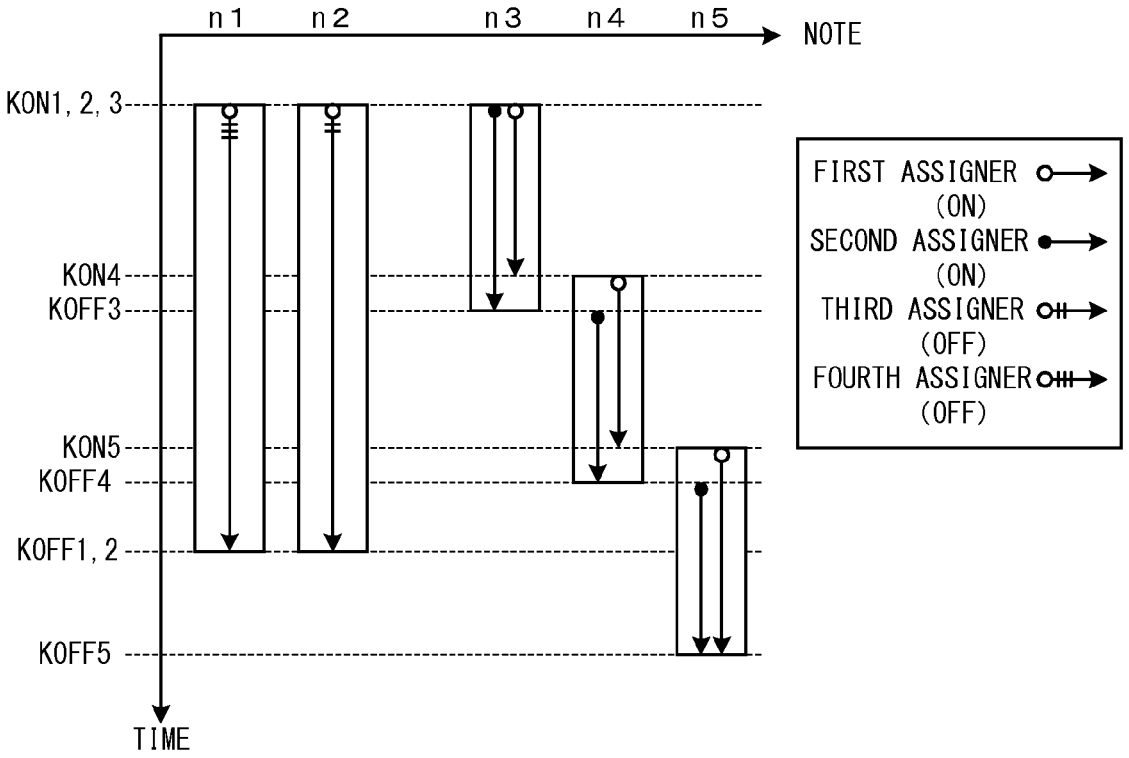
FIG. 10 is still another explanatory diagram thereof.

FIG. 8 to FIG. 10 among them are diagrams for describing how the selection of note to be sounded by each assigner in response to the performance operation will be different according to the setting of ON and OFF of the key-off retrigger with respect to the four assigners illustrated in FIG. 3. In each case, it is assumed that there is no operation of the retrigger release control.

In FIG. 8 to FIG. 10, a vertical axis represents a time, a horizontal axis represents a note, and a strip of each note represents a period in which the key of the note is depressed. In examples of FIG. 8 to FIG. 10, all the timings of the key-on operation and the key-off operation of keys are in common. Here, the key of note n3 is depressed, and before this key is released, the key of note n4 is depressed. Further, before the key of the note n4 is released, the key of note n5 is depressed. In both cases, the key-off operation of the previous note is performed immediately after the key-on operation of the next note. Thus, this performance can be assumed as a performance intended to generate sounds of the notes n3 to n5 sequentially.

Here, the example of FIG. 8 is of the case where the key-off retrigger OFF is set for all the assigners.

In this case, at a first timing KON1,2,3, each assigner AS selects a note to be sounded in a state where keys of three notes n1, n2 and n3 are being depressed. As a result, according to the rule set to each assigner AS illustrated in FIG. 3 and described above, the first assigner AS-1 and the second assigner AS-2 select n3 which is a note of the highest pitch (hereinafter abbreviated as "highest note" or so), the third assigner AS-3 selects the second lowest note n2, and the fourth assigner AS-4 selects the lowest note n1.

At a next timing KON4, each assigner AS selects a note to be sounded in a state where the keys of four notes n1, n2, n3 and n4 are being depressed. As a result, selection by the first assigner AS-1 changes to the present highest note n4 according to the rule set to each assigner AS, and tone generation of the selected note n4 is newly started. Selections by the other three assigners are not different from the selections at the timing KON1,2,4.

Then, at a next timing KOFF3, the tone generation of the note n3 for which the key-off operation is performed is stopped. At this time, since the key-off retrigger is set at OFF for all the assigners, selection of note to be sounded is not newly performed. Thus, tone generation in a timbre corresponding to the second assigner AS-2 which has selected the note n3 is stopped here.

In a next timing KON5, each assigner AS selects a note to be sounded in a state where keys of four notes n1, n2, n4 and n5 are being depressed. As a result, selection by the first assigner AS-1 changes to the present highest note n5 according to the rule set to each assigner AS, and tone generation of the selected note n5 is newly started. The second assigner AS-2 selects the third lowest note n4 and tone generation of the selected note n4 is newly started. Selections by the other two assigners are not different from the selections at the previous timing KON4.

Next, at a timing KOFF4, the tone generation of the note n4 for which the key-off operation is performed is stopped. At this time, since the key-off retrigger is set at OFF for all the assigners, selection of note to be sounded is not newly performed. Accordingly, although it has been just started, tone generation in a timbre corresponding to the second assigner AS-2 which has selected the note n4 is stopped here.

In a next timing KOFF1,2, the tone generations of the notes n1 and n2 for which the key-off operation is performed are stopped. In a next timing KOFF5, the tone generation of the note n5 for which the key-off operation is performed is stopped. Also at these timings, the key-off retrigger is not performed.

As can be seen from the above, if the key-off retrigger is OFF for all the assigners, that is, the key-off retrigger is not performed at all, sounds of the notes n3 to n5, for which it is assumed that the performer intends to generate sounds sequentially, are generated in different timbres. The first note n3 is in a timbre TG1 corresponding to the first assigner AS-1 and a timbre TG2 corresponding to the second assigner AS-2, and the subsequent notes n4 and n5 are only in the timbre TG1 corresponding to the first assigner AS-1. A tone generation in the timbre TG2 also occurs at the end of note n4, but this becomes a tone generation close to noise because its time is short.

Next, the example of FIG. 9 is of the case where the key-off retrigger ON is set for all the assigners. It can be also understood as an example in which the assigners always select a note to be sounded at a time of key-off operation. Differences from FIG. 8 will be described regarding selections of notes by the respective assigners in this case.

In the example of FIG. 9, at a timing KOFF3, unlike FIG. 8, all the assigners select a note to be sounded. As a result, the second assigner AS-2 selects the highest note n4 according to the rule set to each assigner AS, and tone generation of the selected note n4 is newly started. There is no change in selections of the other assigners, and thus they continue the tone generations as have been performed.

Further, also at a timing KOFF4, all the assigners select a note to be sounded. As a result, the second assigner AS-2 selects the highest note n5, and newly starts a tone generation. There is no change in selections by the other assigners, and thus the tone generations as have been performed is continued regarding the notes selected by the other assigners.

Thus, for all the sounds of the notes n3 to n5, tone generations can be performed in the timbre TG1 and the timbre TG2 without causing the timbre TG2 corresponding to the second assigner AS-2 to disappear in mid-course.

However, at the timing KOFF1,2, all the assigners select a note to be sounded. As a result, although there is no change in the selections by the first assigner AS-1 and the second assigner AS-2 from the selections at the previous KOFF4, the third assigner AS-3 and the fourth assigner AS-4 select n5 which is the only note of a depressed key at this point, and tone generation of the selected note n5 is newly started Accordingly, the sound of the timbre which has been sounded on the lower pitch side is suddenly sounded on the higher pitch side. Considering that the key depressions of the notes n1 and n2 are of accompaniment and the key depresses of the notes n3 to n5 are of melody, the melody is sounded suddenly in timbres of the accompaniment, resulting in unnatural tone generations.

Next, an example of FIG. 10 is of the case where the key-off retrigger ON is set for the first assigner AS-1 and the second assigner AS-2, and the key-off retrigger OFF is set for the third assigner AS-3 and the fourth assigner AS-4. Differences from FIG. 8 and FIG. 9 will be described regarding selections of notes by the respective assigners in this case.

In the example of FIG. 10, at timings KOFF3 and KOFF4, only the first assigner AS-1 and the second assigner AS-2 select a note to be sounded. The third assigner AS-3 and the fourth assigner AS-4 do not select a note to be sounded. However, even when the third assigner AS-3 and the fourth assigner AS-4 perform selections as in FIG. 9, these assigners select the same note as the previous selection according to the rule set to each assigner AS, and thus there is no difference in the notes to be sounded either when the selections are performed or not performed.

On the other hand, at a timing KOFF1,2, the third assigner AS-3 and the fourth assigner AS-4 do not select a note to be sounded, and thus tone generation of the note n5 is not newly started as in the example of FIG. 9. The first assigner AS-1 and the second assigner AS-2 select a note, but selections by these assigners are not different from the previous selections at KOFF4, and thus tone generation will not be newly started.

As described above, there are cases where performing the key-off retrigger results in tone generation which matches the performer's intention and the cases where not performing the key-off retrigger results in tone generation which matches the performer's intention, depending on the note selection rule of the assigner and the actually performed performance operation. Therefore, it is conceivable that the tone generation which matches the performer's intention can be realized more easily by allowing setting of whether to perform the key-off retrigger or not in every assigner as illustrated in FIG. 4.

Further, by providing the retrigger release control in addition thereto, the tone generation which matches the performer's intention can be performed still more easily.

Figure 11:
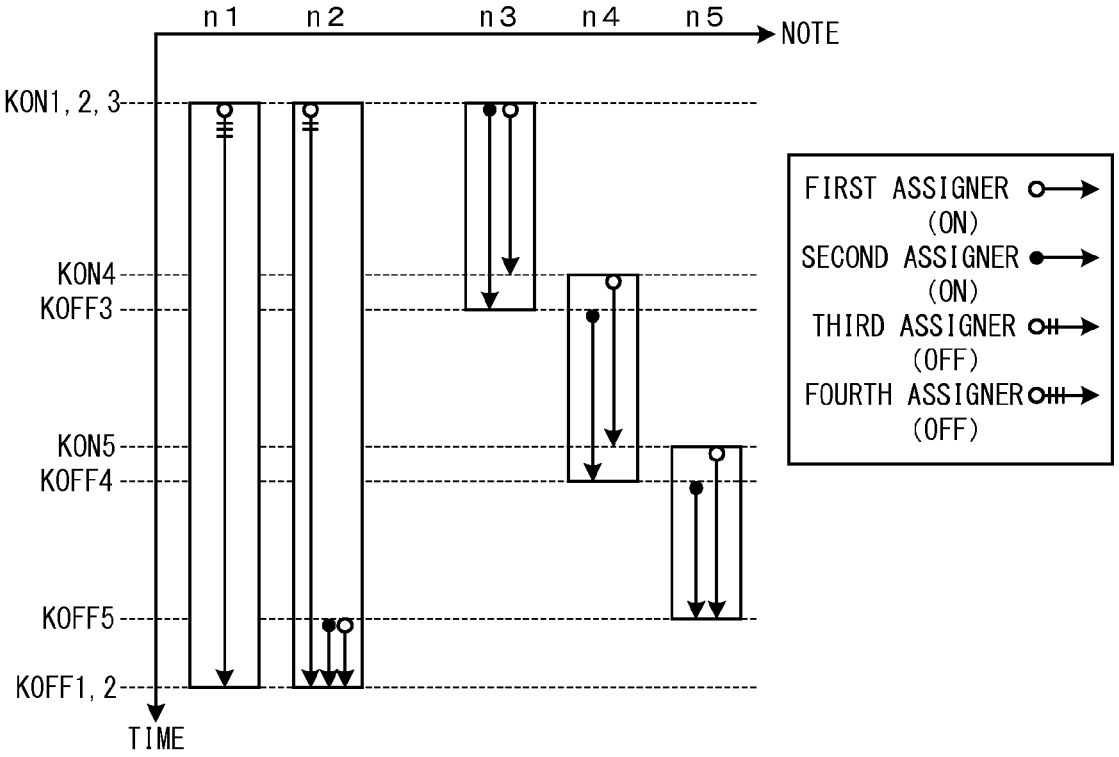
FIG. 11 is still another explanatory diagram thereof.

FIG. 11 illustrates an example of the case where the key-off operations (KOFF1,2) of the notes n1, n2 are after the key-off operation (KOFF5) of n5 as compared to the case of FIG. 10.

In this case, the first assigner AS-1 and the second assigner AS-2 select a note at a timing KOFF5, select the highest note n2 out of the notes n1 and n2 being depressed according to the rule set to each assigner AS, and tone generation of the selected note n2 is newly started.

Accordingly, a timbre which has been sounded on the higher pitch side is suddenly sounded on the lower pitch side, resulting in unnatural tone generations such as sounds of an accompaniment are suddenly generated in timbres of a melody.

However, when the timing KOFF5 is reached in a state where the performer operates the retrigger release control, the first assigner AS-1 and the second assigner AS-2 do not select a note. Therefore, it becomes possible to give a performance which matches the intention of the performer as illustrated in FIG. 10.

Even when setting of the key-off retrigger for every assigner is made an optimum one, a preferred result cannot always be obtained, and thus it is preferred to allow further adjustment by the retrigger release control.

Further, when the retrigger release control has been operated, the retrigger may be prohibited only for a predetermined assigner rather than prohibiting the retrigger for all the assigners. Further, plural retrigger release controls may be prepared, and each of them may be corresponded with a group of one or more assigners and may be used as a control for temporarily stopping the retrigger of the relevant assigners in the corresponding group.

Further, instead of that the user directly sets parameters for setting of the key-off retrigger for every assigner illustrated in FIG. 4, this setting may be performed in conjunction with setting of other parameters. One example is that the CPU 11 automatically sets the key-off retrigger to ON for an assigner which is set by the user to be used for a melody part, and automatically sets the key-off retrigger to OFF for an assigner which is set likewise to be used for an accompaniment part.

Figure 12:
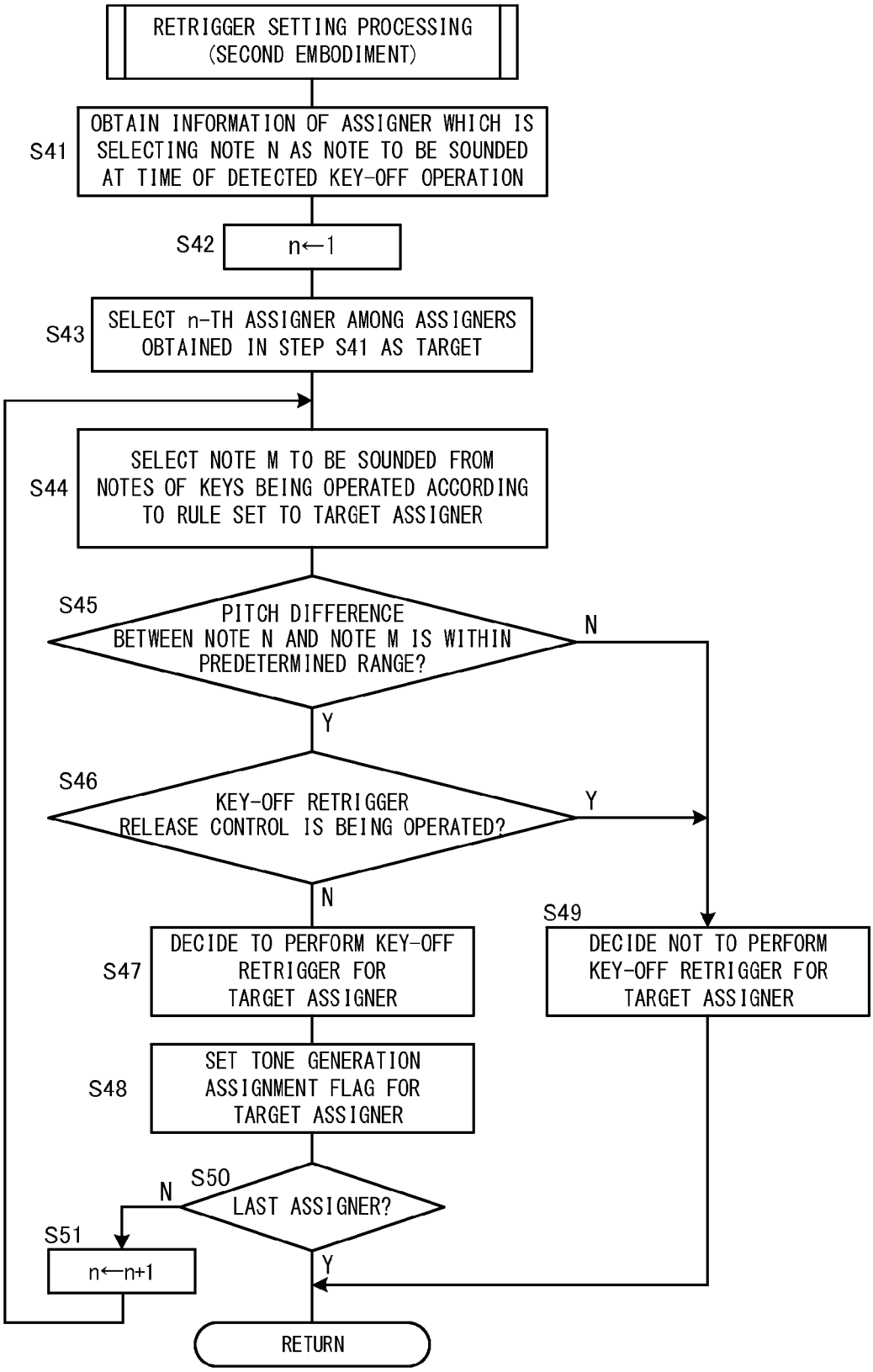
FIG. 12 is a flowchart of retrigger setting processing in a second embodiment.
Figure 13:
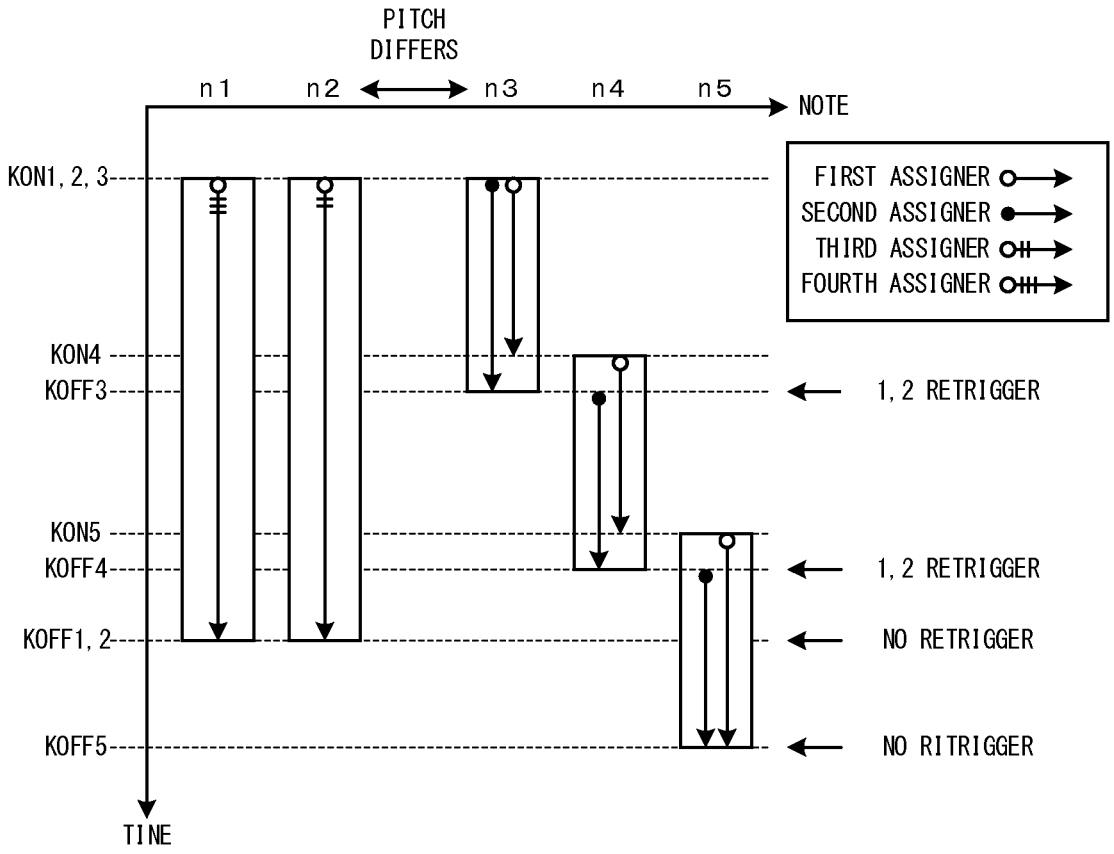
FIG. 13 is an explanatory diagram for describing an effect of the retrigger setting processing of the second embodiment.

[Second Embodiment: FIG. 12 and FIG. 13]

Next, an electronic musical instrument of a second embodiment of this invention will be described.

This second embodiment differs from the first embodiment only in that the key-off retrigger is not performed when a pitch difference is equal to or more than a predetermined value between the note selected by an assigner at a time of key-off operation and a note predicted to be selected by the same assigner according to the operation state of a performance control after the key-off operation, instead of deciding the presence or absence of key-off retrigger according to the setting by the user. Accordingly, only this difference will be described, and same symbols as those in the first embodiment are used for the same or corresponding components to those in the first embodiment.

The electronic musical instrument 10 of the second embodiment has common hardware to that of the first embodiment illustrated in FIG. 1. The functional structure only differs in that the key-off retrigger setter 36 is unnecessary, and that the judgment criterion in the key-off retrigger controller 35 for the presence or absence of key-off retrigger is different from that illustrated in FIG. 2. This corresponds to that, regarding the processing of the CPU 11, the retrigger setting processing of FIG. 7 is different among the processings of FIG. 5 to FIG. 7 illustrated in the first embodiment.

Here, FIG. 12 illustrates a flowchart of retrigger setting processing in the second embodiment. Note that when there are plural key-off operations, the retrigger setting processing will be performed for each key-off operation.

In the processing of FIG. 12, the CPU 11 first obtains information about what order of assigner AS corresponds to a part in which a note N, for which the key-off operation is performed this time, is being sounded (S41). This means to search for an assigner AS which is selecting the note N as a note to be sounded at a time of the key-off operation. When plural assigners fall under this condition, the CPU 11 obtains information of all the plural assigners. This search can be made based on information which each assigner AS retains about a note the assigner As itself selected last time.

The CPU 11 next substitutes 1 for the variable n (S42). Then, the CPU 11 selects the n-th assigner as a target from among the assigners for which information is obtained in step S41 (S43).

Next, for the assigner AS as the target, the CPU 11 selects a note to be sounded from among notes of keys being depressed (in a state after the key-off operation) according to the selection rule set as illustrated in FIG. 3, and defines it as a note M (S44). This note M is a predicted value of a note the target assigner will select according to the operation state of the performance control after the key-off operation.

Then, the CPU 11 judges whether a pitch difference between the note N which the target assigner is selecting at the time of the key-off operation and the note M selected in step S44 is within a predetermined range or not (S45). If it is within the predetermined range, the CPU 11 tentatively decides to perform key-off retrigger for the target assigner AS, and if the retrigger release control is not operated (S46), the CPU 11 finally decides to perform the key-off retrigger (S47). Then, the CPU 11 sets the tone generation assignment flag for the target assigner (S48).

On the other hand, when it is not within the predetermined range in step S45, the CPU 11 decides that key-off retrigger is not performed for the target assigner (S49). In this case, the CPU 11 does not set the tone generation assignment flag for the target assigner. The same applies when the retrigger release control is being operated in step S46.

In either case, thereafter, the CPU 11 judges whether or not the currently processed target assigner is the last assigner obtained in step S41 (S50), and when it is not the last, adds 1 to n (S51), and the process returns to step S43 to repeat the processing.

When it is Yes in step S50, it can be seen that the processing related to all the assigners is finished, and thus the CPU 11 ends the processing of FIG. 12 and returns to the original processing. At this time, since the processing returns to step S17 of FIG. 5, in the processing of FIG. 5 the CPU 11 then proceeds to the tone generation assignment processing of FIG. 6 (S15). In this tone generation assignment processing, the judgment of step S22 is Yes only for the assigner AS for which the tone generation assignment flag is set in step S48, and selection of a note to be sounded and tone generation starting instruction are performed.

By executing the above processing, the CPU 11 can appropriately discriminate, according to operation of the performance control 22 and the selection rules set to the assigners, the case where the assigner AS should perform the selection of the note to be sounded and the tone generation starting instruction in response to the key-off operation, and have it performed. This enables to perform tone generation which matches the intention of the user's performance operation.

The retrigger setting processing in the second embodiment is, while the key-off retrigger is basically enabled for an assigner selecting a note whose tone generation is stopped by the key-off operation, to avoid such situation that a note selected by the assigner largely differs, for example from that of an accompaniment sound to that of a melody sound, due to the key-off retrigger.

This point will be described using FIG. 13. FIG. 13 is a diagram corresponding to FIG. 8 to FIG. 10 and illustrating how a note to be sounded is selected by the assigner in response to the performance operation.

In the example of FIG. 13, the order of the key-on operations and the key-off operations is the same as in FIG. 8 to FIG. 10. However, the pitch difference between the notes n2 and n3 is larger than the predetermined range in step S45 of FIG. 12. Further, there is no setting of the key-off retrigger corresponding to each assigner.

In the example of FIG. 13, selection of a note by each assigner at a time of key-on is the same as in FIG. 10. Selection of a note by each assigner at a time of key-off is the same as in FIG. 10 when only the resultant tone generations are seen, but the processing in the course thereof is different.

First, regarding the key-off retrigger at a timing KOFF3, the second assigner AS-2 which is selecting the note n3 for which the key-off operation is performed becomes a target of consideration. Then, a predicted value of a note to be selected by the second assigner AS-2 according to the operation state after the key-off is the highest depressed note n4. Assuming that the pitch difference between the notes n3 and n4 is within the predetermined range, the CPU 11 decides that the second assigner AS-2 performs the key-off retrigger, and thus the second assigner AS-2 actually selects the note n4 and tone generation of the selected note n4 is newly started.

Also regarding timing KOFF4, the process is the same. Assuming that the pitch difference between the notes n4 and n5 is within the predetermined range, the CPU 11 decides that the second assigner AS-2 performs the key-off retrigger, and thus the second assigner AS-2 actually selects the note n5 and tone generation of the selected note n5 is newly started.

On the other hand, at a timing KOFF1,2, the third assigner AS-3, which is selecting the note n1 for which the key-off operation is performed, and the fourth assigner AS-4 , which is selecting the note n2 for which the key-off operation is performed, become targets of consideration. Then, predicted values of the notes selected by the third assigner AS-3 and the fourth assigner AS-4 according to the operation state after the key-off are both the note n5 of only one depressed key at this timing. However, both of the pitch differences between n1 and n5 and between n2 and n5 are not in the predetermined range. Accordingly, the CPU 11 decides that the third assigner AS-3 and the fourth assigner AS-4 do not perform the key-off retrigger, and as a result, there is no assigner which performs the key-off retrigger at the timing KOFF1,2.

Thus, by deciding whether to perform the key-off retrigger or not by using the predicted pitch difference when it is assumed that the key-off retrigger is performed, it is possible to perform a tone generation similar to FIG. 10 without setting whether to perform the key-off retrigger or not in every assigner. Moreover, since the setting of whether to perform the key-off retrigger or not is not fixed, for example, even when a performance is given in which the number of sounds (number of assigners) of an accompaniment part and a melody part change dynamically, it is possible to prevent occurrence of an automatic unintended sound movement (change in note selection like one at KOFF1,2 of FIG. 9 or KOFF5 of FIG. 11) between the accompaniment part and the melody part following the change.

Note that in the processing of FIG. 12, at the point of the key-off operation, only an assigner AS which is selecting the note N as a note to be sounded is taken as a target of consideration for whether to perform the key-off retrigger or not, and other assigners do not perform the key-off retrigger. This is for allowing the tone generation of the note corresponding to the key being depressed to continue as it is.

However, it is not hindered that the processing of steps S44 and S45 is performed for all the assigners AS to take them as targets of consideration of whether to perform the key-off retrigger or not.

[Third Embodiment: FIG. 14 to FIG. 21]

Next, an electronic musical instrument of a third embodiment of the invention will be described.

This third embodiment differs from the first embodiment only in that when a key-off operation is performed, what performance method is presumed for the key off operation, and whether to perform the key-off retrigger or not is decided based on the presumed performance method. Accordingly, only this difference will be described, and same symbols as those in the first embodiment are used for the same or corresponding components to those in the first embodiment.

Note that in the example described here, it is presumed that the key depression including the detected key-off operation is for legato performance or staccato performance, or something else. However, only one of these performance methods may be considered, or any other performance method may be considered.

The electronic musical instrument 10 of the third embodiment has common hardware to that of the first embodiment illustrated in FIG. 1.

Figure 14:
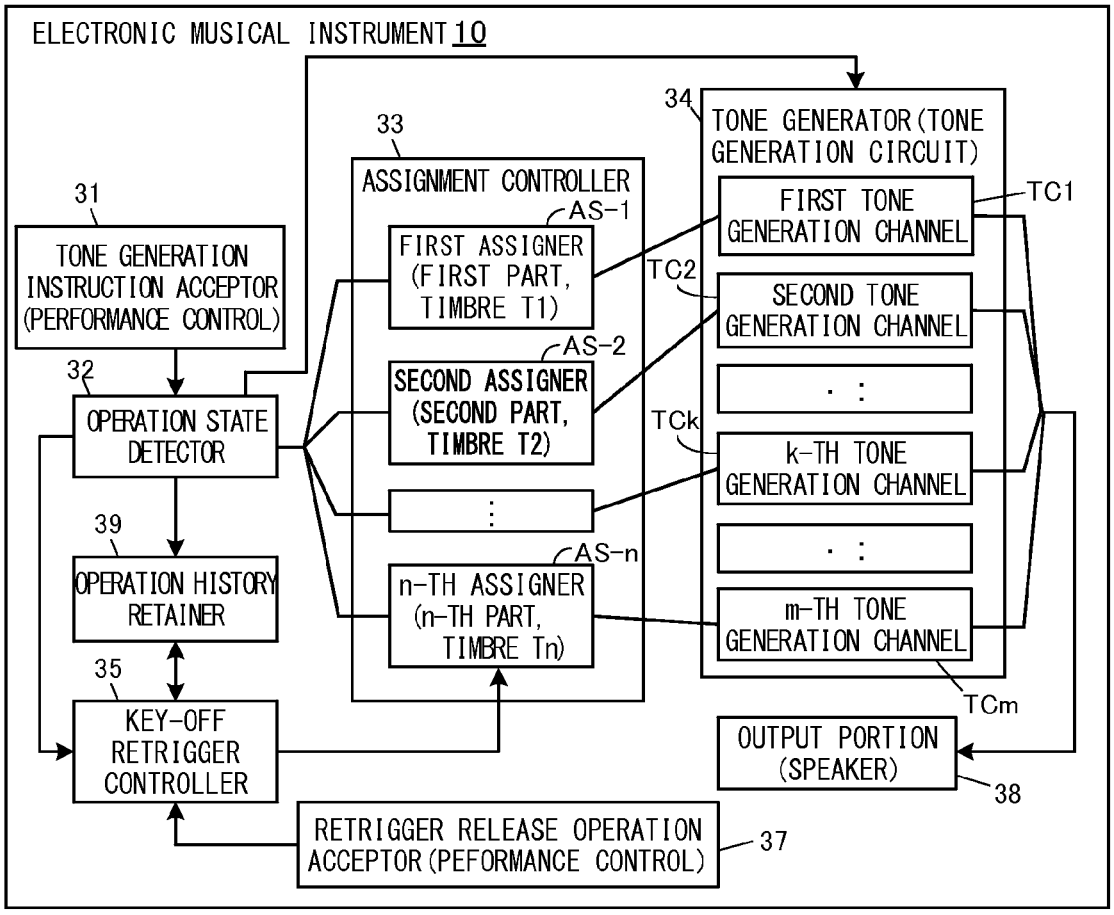
FIG. 14 is a functional block diagram corresponding to FIG. 2 and illustrating a functional structure of an electronic musical instrument of a third embodiment.

FIG. 14 illustrates a functional block diagram corresponding to FIG. 2 in the electronic musical instrument 10 of the third embodiment.

As illustrated in FIG. 14, the electronic musical instrument 10 of the third embodiment has an operation history retainer 39 instead of the key-off retrigger setter 36 in the first embodiment.

Every time the operation state detector 32 detects an operation of the performance control 22, it supplies to the operation history retainer 39 information of the detected operation and information of the operation state of the performance control 22 after reflecting the detected operation, so as to make the operation history retainer 39 store history of the detected operation and the operation state.

The operation history retainer 39 is a retainer having a function to store information of the detected operation and information of the operation state of the performance control 22 supplied from the operation state detector 32 as a history in a time-series manner. The history stored here is used for the above-described presumption of performance method.

Figures 15, 16:
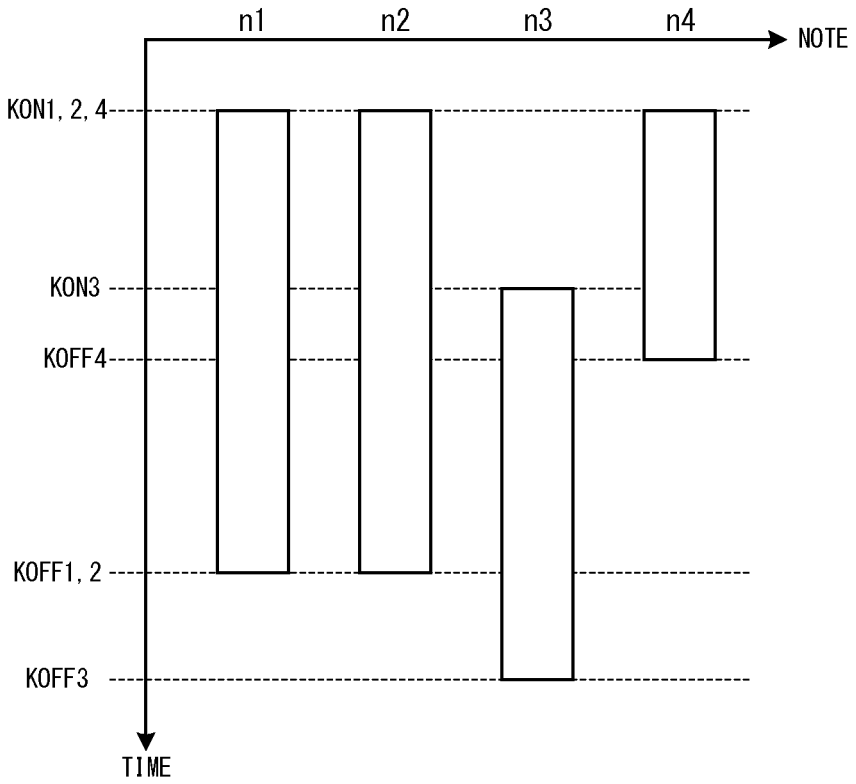
FIG. 15 is a diagram illustrating an example of a performance operation performed in an electronic musical instrument.
FIG. 16 is a diagram illustrating an example of an operating history table.

FIG. 15 illustrates an example of the operation of the performance control 22, and FIG. 16 illustrates an example of an operating history table registering a history corresponding to the operation.

In FIG. 15, a vertical axis represents a time, a horizontal axis represents a note, and a strip of each note represents a period in which a key of the note is depressed. In the example of FIG. 15, a key of the note n4 is depressed, and before this key is released, a key of the note n3 is depressed. Then, the key of the note n4 is released immediately thereafter, and hence this can be assumed as a performance intended to generate sound of note n4 and sound of note n3 sequentially.

In more detail, the key of the note n4 is firstly depressed simultaneously with keys of notes n1 and n2 at a timing KON1,2,4. Then, the key of the note n3 is depressed at a timing KON3, and immediately thereafter, the key of the note n4 is released at a timing KOFF4. Then, the keys of the notes n1 and n2 are released at a timing KOFF1,2, and the key of the note n3 is released at a timing KOFF3.

As illustrated in FIG. 16, the history stored by the operation history retainer 39 includes information of the operation states (key depression states here) and information of the detected operations of the performance control 22 at respective points of time.

Here, the operation history retainer 39 adds new information to the operation history table every time it receives information of the detected operation and information of the operation state from the operation state detector 32. At this time, for just making a presumption related to legato, it is not necessary to measure the time of each operation, and it will suffice if the order thereof is identified. However, when the presumption related to staccato is performed, the time of each operation is measured accurately and recorded. In the example of FIG. 16, in the field of time, times of respective points are denoted by t(n) using a variable n indicating the order, such as t(2), t(3), . . . , beginning from t(1), but whether to make the actual data as information indicating merely an order or as exact times may be determined based on what presumption is to be made on what performance method.

In the item of the key depression state, the note (of a key) being depressed at this point indicated by the information of the operation state notified from the operation state detector 32 is registered. The notes may be registered in order of pitches thereof irrespective of being ascending order or descending order. This is for later use of the information of the order of pitches.

In the items of the detected operations, the information of the detected operations notified from the operation state detector 32 is registered using notes of an operated key. By referring to the history of the detected operations in a time-series manner, the order of key operations can be comprehended.

When the key operation illustrated in FIG. 15 occurs, the operation history retainer 39 first registers that the notes being depressed at a time t(1) are n1, n2 and n4, and the detected operation at this point are key-on of n1, n2 and n4, corresponding to the simultaneous key-on operations of the keys of notes n1, n2 and n4 at a timing KON1,2,4.

Next, the operation history retainer 39 registers that the notes being depressed at a next time t(2) are n1, n2, n3 and n4, and the detected operation at this point in key-on of n3, corresponding to the key-on operation of the key of the note n3 at a timing of KON3. Thereafter, similarly, information at time points of KOFF4, KOFF1,2 and KOFF3 are registered as information at the times t(3), t(4) and t(5).

This operation history table may be stored in the RAM 13 for example. However, it may be stored in an arbitrary storage device including one outside the electronic musical instrument 10.

Note that regarding the information of the key depression state and the detected operation illustrated in FIG. 16, when one of them can be referred in a time-series manner, the other information can be created based on the one information. Therefore, it is not always necessary to store both the histories. Further, as will be described later, this history is not one to be referred largely retrospectively from the most recent point, and thus old data may be deleted whenever necessary while leaving an appropriate number of data pieces, so as not to overweigh the storage capacity.

Regarding the other points, the judgment criterion for the presence or absence of key-off retrigger in the key-off retrigger controller 35 is different from that illustrated in FIG. 2. Note that this difference corresponds to that, regarding the processing of the CPU 11, the retrigger setting processing of FIG. 7 is different among the processing of FIG. 5 to FIG. 7 illustrated in the first embodiment.

Figure 17:
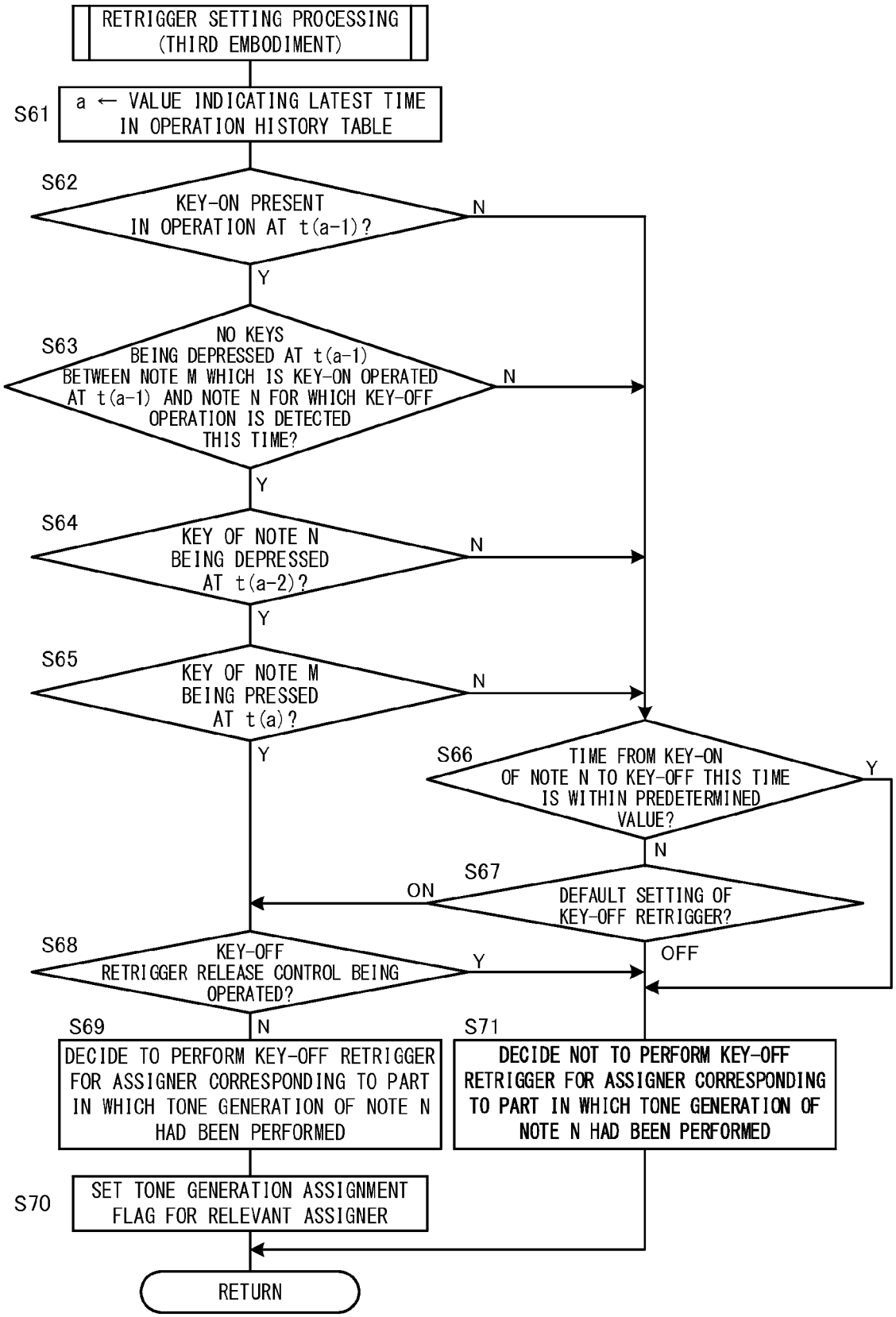
FIG. 17 is a flowchart of retrigger setting processing in the third embodiment.

Here, FIG. 17 illustrates a flowchart of retrigger setting processing in the third embodiment. Note that when there are plural key-off operations, the retrigger setting processing will be performed for each key-off operation.

In the processing of FIG. 17, the CPU 11 first substitutes, for a variable a, a value indicating the latest time in the operation history table updated in step S11 of FIG. 5 (S61). In the case where the operation history table of FIG. 16 is created, if the processing of FIG. 17 is performed at a time of key-off of the note n4, the variable a equals to 3 (at this point, data of t(4) and t(5) are not registered in the table yet).

Next, the CPU 11 judges whether the key-off operation detected this time satisfies predetermined conditions or not by referring to the operation history table (S62 to S65). These judgments here are for presuming whether the key-off operation detected this time is an operation for legato performance or not.

This condition is such that, for example, assuming that the note of the key for which the key-off operation as the trigger of the judgment is performed is note N (n4 in the example of FIG. 15), there is a note M (n3 in the example of FIG. 15) different from the note N satisfying the conditions that: operations are performed in the order of key-on operation of the key of the note N, key-on operation of the key of a note M, and key-off operation of the key of the note N; and at the point of key-on operation of the key of the note M, no keys of the note between the note M and the note N are operated.

Among the above ones, the condition regarding the operation order is for judging that operations of keys, tone generation instruction periods of which partially overlaps with each other, are performed, like the note n4 and the note n3 of FIG. 15.

Further, the condition that no keys of the note between the note M and the note N are operated (condition of pitch order) is to consider characteristics of legato performance. That is, the operation as in FIG. 15 is performed typically in the case of legato performance, but in this case, it is rare that, at a timing when the depression operation moves from first key to second key in succession, another key is depressed at a pitch between the first key and the second key. Then, when such another key is depressed, the detected operations are not construed as those for legato performance but as those intended to change the number of notes, and thus it is preferred not to perform re-selection of a note to be sounded.

Note that also when a melody and an accompaniment are performed with a left and right hand, it is possible that a key depression period of some keys overlap with each other in a manner like legato performance by accident. To efficiently distinguish such a performance, it is conceivable to add a condition that pitch difference between the note M and the note N is within a predetermined value.

This is because, in the case of legato performance, it is rare that notes (pitches) of two keys being depressed in succession is separated largely, but in the melody and the accompaniment, normally notes of keys being depressed are separated to a certain degree.

Conditions used in steps S62 to S65 are examples of making the above conditions of operation order and pitch order more specific so as to directly correspond to the data registered in the operation history table.

In steps S62 to S65, the CPU 11 judges whether all of the following conditions hold true or not:

i) key-on is present in an operation detected at time t(a-1);

ii) there is no keys being depressed at time t(a-1) between the note M for which a key-on operation is performed at the time t(a-1) and the note N for which the key-off operation is detected this time;

iii) the key of the note N is being depressed at time t(a-2); and iv) the key of the note M is being depressed at time t(a).

When all the conditions hold true, the CPU 11 presumes that the key-off operation detected this time is an operation for legato performance. In this case, the CPU 11 tentatively decides to perform key-off retrigger for the assigner AS corresponding to a part in which tone generation of the note N had been performed before the tone generation of the note N is stopped in step S16 of FIG. 5, and finally decides to perform the key-off retrigger (S69) if the retrigger release control is not being operated (S68). Then, the CPU 11 set the tone generation assignment flag for the relevant assigner (S70). The processing of step S70 can be considered as to set the tone generation assignment flag for the assigner AS selecting the note for which the key-off operation is performed.

On the other hand, when there is No in any one of steps S62 to S65, the CPU 11 presumes that the key-off operation detected this time is not an operation for legato performance. Then, next, the CPU 11 judges whether or not the time from the key-on of the note N to the key-off this time is within a predetermined value (S66). That is, the CPU 11 judges whether the depression period of the key for which the key-off operation is performed this time is within the predetermined value or not.

Here, if it is Yes, the CPU 11 presumes that the key-off operation detected this time is an operation for staccato performance. In this case, the CPU 11 decides that key-off retrigger is not performed for the same assigner AS as in the case of above step S69 and step S70 (S71). In this case, the tone generation assignment flag is not set for the relevant assigner. The same applies if the retrigger release control is being operated in step S68.

Further, if it is No in step S66, the CPU 11 presumes that the key-off operation detected this time is an operation other than that for legato performance or staccato performance. In this case, the CPU decides presence or absence of key-off retrigger according to a default setting registered in advance (S67). However, also in this case, if the retrigger release control is being operated, the key-off retrigger is not performed (S68). Further, the default setting may either be common to all the assigners or settable in every assigner.

In either case, after step S70 or S71, the CPU 11 returns to the original processing.

At this time, since the processing returns to step S17 of FIG. 5, in the processing of FIG. 5 the CPU 11 proceeds to the tone generation assignment processing of FIG. 6 (S15). In this tone generation assignment processing, the judgment of step S22 is Yes only for the assigner AS for which the tone generation assignment flag is set in step S70, and selection of a note to be sounded and tone generation starting instruction are performed. When there is no tone generation assignment flag for all the assigners, selection of a note to be sounded and tone generation starting instruction will not be performed.

By executing the above processing, the CPU 11 can appropriately discriminate the case where the assigner AS should perform the selection of the note to be sounded and the tone generation starting instruction based on the performance method of the key-off operation, and have it performed. This enables to perform a tone generation which matches the intention of the user's performance operation.

This point will be described using FIG. 18 to FIG. 21.

Figure 18:
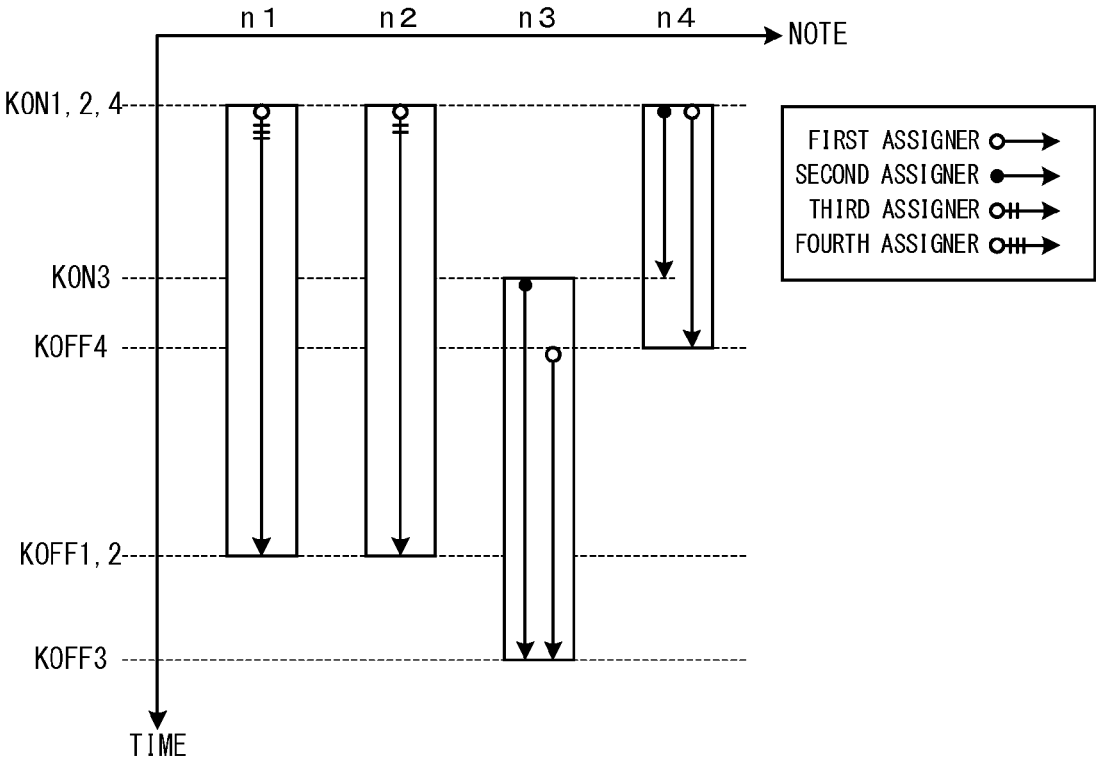
FIG. 18 is an explanatory diagram for describing an effect of the retrigger setting processing in the third embodiment.

FIG. 18 is a diagram corresponding to FIG. 8 and so on and illustrating how tone generations are performed when the processing illustrated in FIG. 5, FIG. 6 and FIG. 17 is executed in response to the operation illustrated in FIG. 15, and the four assigners illustrated in FIG. 3 selects notes to be sounded.

In this case, at a first timing KON1,2,4, in a state where keys of three notes n1, n2 and n4 are depressed, the respective assigners AS select a note to be sounded. As a result, the first assigner AS-1 and the second assigner AS-2 select the highest note n4, the third assigner AS-3 selects the second lowest note n2, and the fourth assigner AS-4 selects the lowest note n1.

At a next timing KON3, in a state where keys of four notes n1, n2, n3 and n4 are depressed, the respective assigners AS select a note to be sounded. As a result, selection by the second assigner AS-2 changes to the present third lowest note n3. Selection of the other three assigners are not different from the selections at the timing KON1,2,4.

Then, in a next timing KOFF4, the tone generation of the note n4 for which the key-off operation is performed is stopped. However, the key-off operation at this time satisfies all the conditions of steps S32 to S35 of FIG. 8. Accordingly, the first assigner AS-1 which is selecting the note n4 for which the tone generation is stopped selects a note to be sounded from among the three notes n1, n2 and n3 of the keys being depressed at this point. As a result, the first assigner AS-1 selects the highest note n3. The other assigners do not select a note at this point, and thus the selecting state at the timing KON3 is maintained.

As a result, as illustrated in FIG. 18, even when presence or absence of key-off retrigger is not set for every assigner, it is possible to perform, in response to the key depression of the note n3 by legato performance, tone generation in timbres T1 and T2 corresponding to the first and second assigners AS-1 and AS-2 which are also used at a time of the previous key depression of the note n4.

Figure 19:
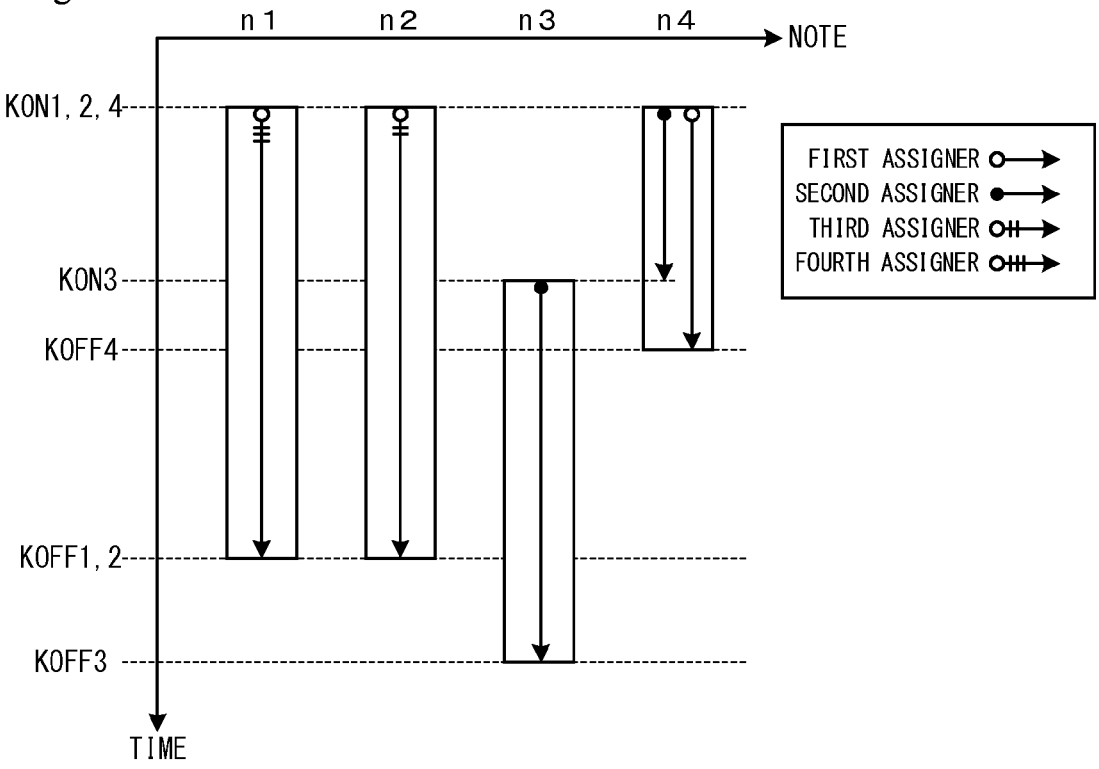
FIG. 19 is another explanatory diagram thereof.

Next, FIG. 19 illustrates how tone generations corresponding to FIG. 18 are performed in a comparative example in which the retrigger judgment processing is not performed.

In this case, at a timing KOFF4, the first assigner AS-1 will not select the note n3, and thus a tone generation in the timbre corresponding to the first assigner AS-1 remains stopped at the timing KOFF4. Thus, the tone generation corresponding to the key depression of the note n3 is performed only in the timbre T2 corresponding to the second assigner AS-2.

Therefore, the tone generation corresponding to the key depression of the note n3 is performed in a timbre different from the case of the tone generation corresponding to the previous key depression of note n4, which does not match the performer's intention. In other words, by performing the retrigger judgment processing of FIG. 17, such a failure can be prevented.

Figure 20:
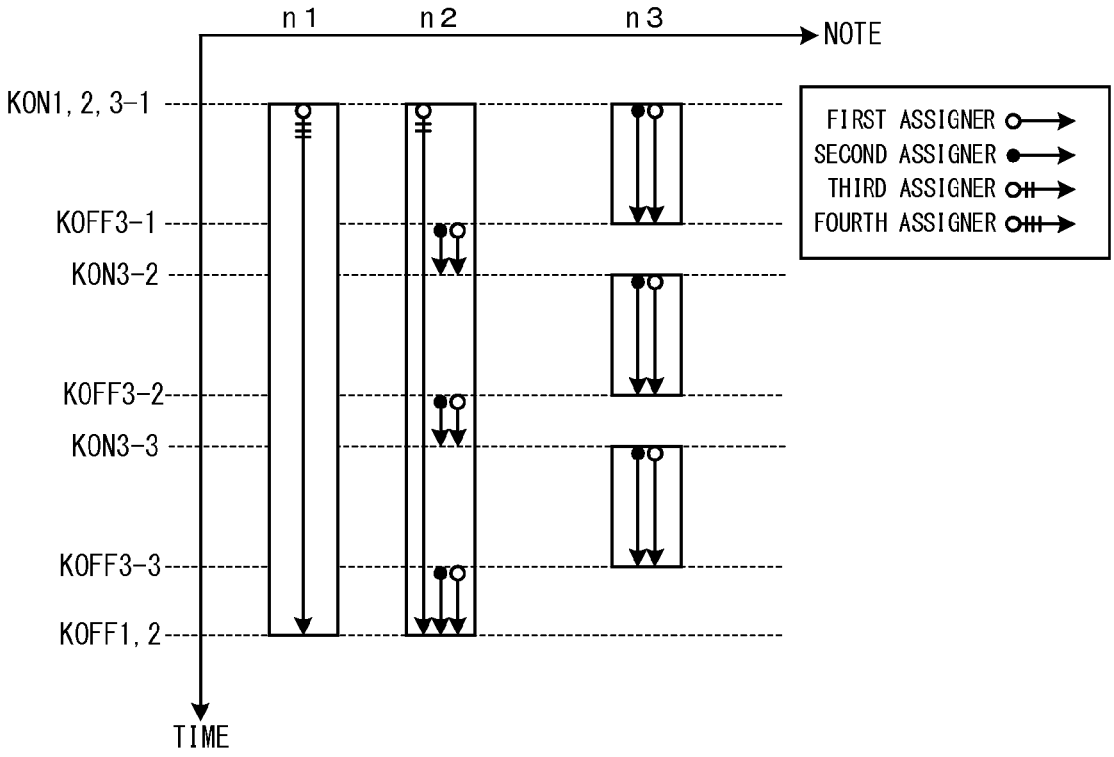
FIG. 20 is still another explanatory diagram thereof.
Figure 21:
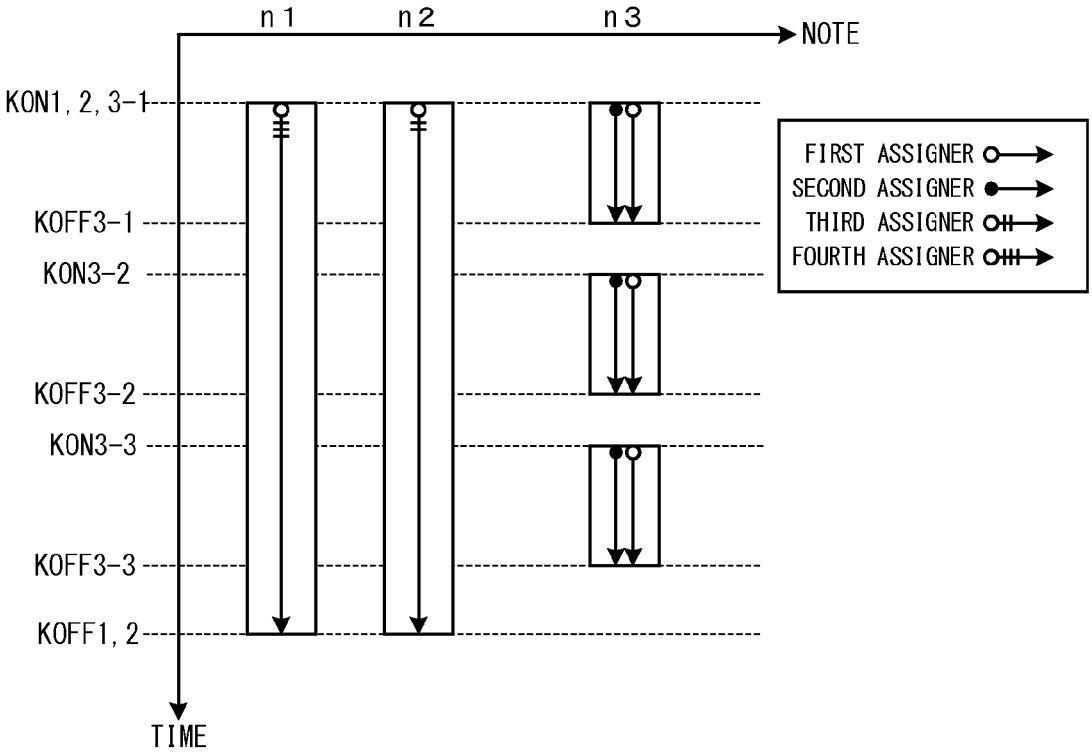
FIG. 21 is still another explanatory diagram thereof.

FIG. 20 and FIG. 21 are diagrams corresponding to FIG. 18 and FIG. 19 and illustrating how tone generations are performed when there is a performance operation for staccato performance. It is assumed that respective times of three key depressions at the note n3 are all within the predetermined value in step S66 of FIG. 17. That is, they are key depressions for staccato performance. Accordingly, there is a slight gap from a previous key depression to a next key depression.

In this case, at a first timing KON1,2,3-1, the respective assigners AS select a note to be sounded in a state where keys of three notes n1, n2 and n3 are being depressed. As a result, the first assigner AS-1 and the second assigner AS-2 select the highest note n3, the third assigner AS-3 selects the second lowest note n2, and the fourth assigner AS-4 selects the lowest note n1.

FIG. 20 is an example of the case where, although operations for staccato performance are being performed, the key-off retrigger is performed for the first assigner AS-1 and the second assigner AS-2 which are selecting the note n3 at timings of key-off operations (KOFF3-1, KOFF3-2 and KOFF3-3) of the note n3.

In this case, the first assigner AS-1 and the second assigner AS-2 select the highest note n2 at times of the key-off retrigger, and tone generation of the selected note n2 is newly started. Then, at a timing of key-on operation of the note n3 thereafter, the first assigner AS-1 and the second assigner AS-2 select the note n3 again and tone generation of the selected note n3 is newly started again. Therefore, despite that the performer plays the same note continuously by staccato performance, the generated sound rapidly repeats sounds of the note n2 and the note n3.

FIG. 21 is an example of the case where the key-off retrigger is not performed at a time of a key-off operation which is presumed to be for staccato performance by the retrigger judgment processing illustrated in FIG. 17.

In this case, the key-off retrigger does not occur at timings (KOFF3-1, KOFF3-2 and KOFF3-3) of the key-off operations of the note n3. Therefore, the sounds of the note n3 in timbres TG1 and TG2 corresponding to the first assigner AS-1 and the second assigner AS-2 are generated three times with a slight gap, which matches the intension of the performer.

Note that in the processing of FIG. 17, when the key-off operation is detected, only the assigner AS which is selecting the note N as the note to be sounded is taken as the target of consideration of whether to perform the key-off retrigger or not, and the other assigners do not perform the key-off retrigger. This is for allowing the tone generation of the notes corresponding to the keys being depressed to continue without any change.

[Modification Example: FIG. 22]

The description of the embodiments is thus finished, but of course the structures of devices, structures of controls such as the performance control, structures of data to be used in processing, specific procedures of processing, and so on are not limited to those explained in the above-described embodiment.

For example, in the retrigger judgment processing illustrated in FIG. 17, it is conceivable to change the condition for presuming as legato performance to that, even when there is no key-on at the time t(a-1), if the conditions regarding operation order and pitch order explained in the description of FIG. 17 are satisfied, the setting of the tone generation assignment flag is made. Besides that, it is possible to employ an arbitrarily different condition in a manner matching the intention that what kind of tone generation is desired to be performed, for example, considering only part of the conditions i) to iv) explained in the description of FIG. 17.

Further, in the above-described embodiments, an example is explained in which the key-off retrigger controller 35 is provided separately from the assignment controller 33. However, each assigner AS of the assignment controller 33 may have the function of the key-off retrigger controller 35. In this case, when the operation state detector 32 receives key-off data, the operation state detector 32 preferably notifies each assigner AS of the assignment controller 33 of information of the operation indicated by the key-off data similarly to the case of key-on data. Then, when each assigner AS is notified of a key-off operation of a note which the assigner AS itself is selecting, the assigner preferably judge necessity of the key-off retrigger based on the predetermined conditions as described using FIG. 7, FIG. 12 and FIG. 17 and the like, and when it is judged as necessary, the assigner AS may perform retrigger processing as in steps S23 and S24 of FIG. 6.

Note that in the first embodiment, when the key-off operation is performed, the processing from step S32 and on is performed regarding all the assigners, but the processing from step S32 and subsequent steps may be performed only regarding the assigner AS which is selecting a note for which the key-off operation is being performed.

Further, when it is No in step S12 of FIG. 5, the tone generation assignment flag may be set for the assigner corresponding to a part used in tone generation of a note related to the key-off operation, and the flag may be cleared for an assigner for which it is decided not to perform the key-off retrigger in the retrigger setting processing.

Note that when such processing is adopted to the first embodiment, the tone generation assignment flag is set according to the retrigger setting of FIG. 4 only for the part used in the tone generation of the note related to the key-off operation, and the tone generation assignment flag will not be set for other parts from the first.

Further, the function of the retrigger release control in the above-described embodiments may be provided independently. Specifically, it is conceivable that presence or absence of the key-off retrigger is decided based only on operation state of the retrigger release control, or in addition, based on whether or not the assigner AS is selecting the note for which the key-off operation is performed.

Further, regarding the rules of selecting a note to be set for each assigner, as illustrated in FIG. 22, one defining different behaviors depending on the number of key depressions is applicable. In FIG. 22, for the second assigner and the third assigner, the rules are defined only up to four key depressions, but the rule may be defined for the case where the number of key depressions is five or more.

Further, in the above-described embodiments, an example is explained in which the retrigger release control is provided as a separate control from the keyboard. However, any of the keys on the keyboard, such as the key at an end of the keyboard, may be used as the retrigger release control.

Further, instead of or in addition to the control for instructing to temporarily disable the key-off retrigger, a control for instructing to temporarily enable the key-off retrigger may be provided. When the key-off operation occurs while this control is operated, it is conceivable to forcibly make all the assigners AS, or all the assigners AS which is selecting the note for which the key-off operation is performed, perform the key-off retrigger.

Further, it is also conceivable that the user can set a range of assigners for which the key-off retrigger is disabled or enabled temporarily according to operation of these controls.

Further, in the above-described embodiments, an example is described in which the performance control is the keyboard, and the tone generation starting instruction is performed by a key depressing operation and the tone generation stopping instruction is performed by a key releasing operation. However, configuration of the performance control is not limited to this. The invention is applicable to apparatuses provided with a user interface having a shape of another musical instrument of course, or a shape completely different from traditional musical instruments, such as a pad on which controls (portions to be operated) are disposed in a matrix form. In this case, the tone generation starting instruction and the tone generation stopping instruction are accepted by an operating method according to characteristics of the user interface.

Further, it is also not necessary that the electronic musical instrument 10 incorporates the performance control. It is also conceivable that performance data indicating operation of the performance control are obtained from an external controller connected to the communication I/F 15, and the electronic musical instrument 10 comprehends operation state of each controls based on the performance data.

Further, it is also conceivable to use as the performance control a keyboard of a general-purpose computer or a GUI (graphical user interface) displayed on a touch panel. In this case, by causing the general-purpose computer to realize the functions of respective parts illustrated in FIG. 2 and so on, the computer can function as an electronic musical instrument. Further, in any case, the functions of the respective parts illustrated in FIG. 2 and so on are provided while distributing the functions to plural devices, and the functions of the electronic musical instrument 10 can be realized through cooperation among the plural device.

A program as an embodiment of the invention is one for realizing the functions of respective parts (particularly the key-off retrigger controller 35) illustrated in FIG. 2 and so on by one computer or by plural computers operating in conjunction.

Then, by making the computer or computers execute such a program, effects as described above can be obtained.

Such a program may be stored in a ROM originally provided in a computer or in another non-volatile storage medium (flash memory, EEPROM, or the like), or the like. However, it can also be provided in a form of recorded in an arbitrary non-volatile storage medium such as a memory card, CD, DVD, Blu-ray Disk, or the like. By installing and running the program recorded in such a storage medium in a computer, the above-described respective steps can be executed.

Moreover, the program can also be downloaded from an external apparatus connected to a network and having a storage medium recording the program or an external apparatus in which the program is stored in a memory, and installed and executed in a computer.

Further, the structures of the embodiments and variants as have been described can of course be arbitrarily combined and implemented unless they contradict one another.

INDUSTRIAL APPLICABILITY

As is clear from the above description, according to the invention, it is possible to easily perform a tone generation which matches the intention of a performance operation by a performer when one or more selectors are made to select notes to be sounded according to an operation state of controls.

Therefore, by applying the invention, convenience of an electronic musical instrument can be improved.

REFERENCE SIGNS LIST

10: electronic musical instrument, 11: CPU, 12: ROM, 13: RAM, 14: storage device, 15: communication I/F, 16: detection circuit, 17: display circuit, 18: tone generation circuit, 19: system bus, 21: timer, 22: performance control, 23: setting control, 24: display, 25: DAC, 26: sound system, 31: tone generation instruction acceptor, 32: operation state detector, 33: assignment controller, 34: tone generator, 35: key-off retrigger controller, 36: key-off retrigger setter, 37: retrigger release operation acceptor, 38: output portion, 39: operation history retainer, AS: assigner, TC: tone generation channel

The invention claimed is:

1. An electronic musical instrument, comprising:

a plurality of selectors, each selector respectively configured to select, in accordance with a rule set for the selector, a note to be sounded according to operation state of plural controls corresponding respectively to notes;

a decider configured to decide, for each of the plurality of selectors, whether or not to select a note to be sounded in response to a tone generation stopping operation of any of the controls; and a controller configured to instruct, when a tone generation stopping operation of any of the controls is detected, a selector for which the decider decided to select a note to be sounded, to select, in accordance with the rule set for the selector, a note to be sounded according to operation state of the plural controls after the detection of the tone generation stopping operation, wherein the decider decides, for each of the plurality of selectors, that, when the tone generation stopping operation of any of the controls is detected, if pitch difference is equal to or more than a predetermined value between a note selected by one selector at a timing of the detection and a note predicted to be selected by the one selector according to operation state of the plural controls after the detection of the tone generation stopping operation, the one selector does not select a note to be sounded in response to a tone generation stopping operation of any of the controls, and if the pitch difference is less than the predetermined value, the one selector selects a note to be sounded in response to a tone generation stopping operation of any of the controls.

2. The electronic musical instrument according to claim 1, wherein while a certain control is operated, the decider forcibly decides for a predetermined selector among the plurality of selectors either one of to select or not to select a note to be sounded in response to a tone generation stopping operation of any of the controls.

3. The electronic musical instrument according to claim 1, wherein, for each of the plurality of selectors, the rule related to a note to be selected by the selector and a timbre to be applied to a sound of a note selected by the selector are set in advance.

4. A non-transitory machine-readable storage medium containing program instructions executable by a computer and enabling the computer to function as:

a plurality of selectors, each selector respectively configured to select, in accordance with a rule set for the selector, a note to be sounded according to operation state of plural controls corresponding respectively to notes;

a decider configured to decide, for each of the plurality of selectors, whether or not to select a note to be sounded in response to a tone generation stopping operation of any of the controls; and a controller configured to instruct, when a tone generation stopping operation of any of the controls is detected, a selector for which the decider decided to select a note to be sounded, to select, in accordance with the rule set for the selector, a note to be sounded according to operation state of the plural controls after the detection of the tone generation stopping operation, wherein the decider decides, for each of the plurality of selectors, that, when the tone generation stopping operation of any of the controls is detected, if pitch difference is equal to or more than a predetermined value between a note selected by one selector at a timing of the detection and a note predicted to be selected by the one selector according to operation state of the plural controls after the detection of the tone generation stopping operation, the one selector does not select a note to be sounded in response to a tone generation stopping operation of any of the controls, and if the pitch difference is less than the predetermined value, the one selector selects a note to be sounded in response to a tone generation stopping operation of any of the controls.

5. An electronic musical instrument, comprising:

a processor configured to perform:

selecting, for each of a plurality of selectors respectively, in accordance with a rule set for the selector, a note to be sounded according to operation state of plural controls corresponding respectively to notes, the plurality of selectors realized by the processor;

deciding, for each of the plurality of selectors, whether or not to select a note to be sounded in response to a tone generation stopping operation of any of the controls; and instructing, when a tone generation stopping operation of any of the controls is detected, a selector for which the decider decided to select a note to be sounded, to select, in accordance with the rule set for the selector, a note to be sounded according to operation state of the plural controls after the detection of the tone generation stopping operation, wherein in the deciding, for each of the plurality of selectors, when the tone generation stopping operation of any of the controls is detected, if pitch difference is equal to or more than a predetermined value between a note selected by one selector at a timing of the detection and a note predicted to be selected by the one selector according to operation state of the plural controls after the detection of the tone generation stopping operation, it is decided that the one selector does not select a note to be sounded in response to a tone generation stopping operation of any of the controls, and if the pitch difference is less than the predetermined value, it is decided that the one selector selects a note to be sounded in response to a tone generation stopping operation of any of the controls.

6. The electronic musical instrument according to claim 5, wherein in the deciding, while a certain control is operated, for a predetermined selector among the plurality of selectors, either one of to select or not to select a note to be sounded in response to a tone generation stopping operation of any of the controls is forcibly decided.

7. The electronic musical instrument according to claim 5, wherein, for each of the plurality of selectors, the rule related to a note to be selected by the selector and a timbre to be applied to a sound of a note selected by the selector are set in advance.

8. A non-transitory machine-readable storage medium containing program instructions executable by one or more computers and enabling the one or more computers to perform:

selecting, for each of a plurality of selectors respectively, in accordance with a rule set for the selector, a note to be sounded according to operation state of plural controls corresponding respectively to notes;

deciding, for each of the plurality of selectors, whether or not to select a note to be sounded in response to a tone generation stopping operation of any of the controls; and instructing, when a tone generation stopping operation of any of the controls is detected, a selector for which the decider decided to select a note to be sounded, to select, in accordance with the rule set for the selector, a note to be sounded according to operation state of the plural controls after the detection of the tone generation stopping operation, wherein in the deciding, for each of the plurality of selectors, when the tone generation stopping operation of any of the controls is detected, if pitch difference is equal to or more than a predetermined value between a note selected by one selector at a timing of the detection and a note predicted to be selected by the one selector according to operation state of the plural controls after the detection of the tone generation stopping operation, it is decided that the one selector does not select a note to be sounded in response to a tone generation stopping operation of any of the controls, and if the pitch difference is less than the predetermined value, it is decided that the one selector selects a note to be sounded in response to a tone generation stopping operation of any of the controls.

* * * * *